US005769311A

United States Patent [19]

Morita et al.

[11] Patent Number: 5,769,311

[45] Date of Patent: Jun. 23, 1998

[54] HEAT INSULATING CUP AND METHOD OF MANUFACTURING THE SAME

[75] Inventors: Noriko Morita, Kawasaki; Makoto Igarashi, Yokohama; Tadayo Hirano, Kanagawa-ken; Sakae Furuki, Sagamihara; Jun Sada, Urawa; Yoshiaki Take, Tama; Yoshihiro Akima, Hachioji; Hiroya Shiki, Sagamihara; Teruaki Iyori, Isehara; Nobumasa Yamazaki, Tokyo; Kunihiko Aso, Koshigaya, all of Japan

[73] Assignee: Toppan Printing Co., Ltd., Tokyo, Japan

[21] Appl. No.: 525,066

[22] Filed: Sep. 8, 1995

Related U.S. Application Data

[63] Continuation-in-part of Ser. No. 451,322, May 26, 1995, abandoned.

[30] Foreign Application Priority Data

| | | | |
|---|---|---|---|
| Aug. 2, 1994 | [JP] | Japan | 6-181149 |
| Feb. 20, 1995 | [JP] | Japan | 7-030827 |

[51] Int. Cl.[6] ..... B65D 3/22

[52] U.S. Cl. ..... 229/403; 220/418; 220/443; 220/445

[58] Field of Search ..... 229/403, 400; 220/416, 418, 443, 445; 73/426, 427

[56] References Cited

U.S. PATENT DOCUMENTS

| | | | |
|---|---|---|---|
| 2,246,426 | 6/1941 | Wickstrom . | |
| 2,395,267 | 2/1946 | Gilbert | 73/426 |
| 2,563,352 | 8/1951 | Morse | 229/403 |
| 2,853,222 | 9/1958 | Gallagher | 229/403 |
| 3,082,900 | 3/1963 | Goodman | 229/403 |
| 3,908,523 | 9/1975 | Shikaya | 229/403 |
| 4,347,934 | 9/1982 | Goodman . | |
| 4,993,580 | 2/1991 | Smith . | |
| 5,092,485 | 3/1992 | Lee | 229/403 |
| 5,205,473 | 4/1993 | Coffin, Sr. | 229/403 |
| 5,226,585 | 7/1993 | Varano | 229/403 |
| 5,363,982 | 11/1994 | Sadlier . | |

FOREIGN PATENT DOCUMENTS

| | | | |
|---|---|---|---|
| 993163 | 10/1951 | France | 73/426 |
| 2206240 | 6/1974 | France . | |
| 2397987 | 2/1979 | France . | |
| 2481229 | 10/1981 | France . | |
| 1786171 | 2/1972 | Germany . | |
| 2330767 | 1/1975 | Germany . | |
| 57-6333 | 5/1982 | Japan . | |
| 142419 | 6/1986 | Japan | 73/426 |
| 6-39717 | 5/1994 | Japan . | |
| 6-61773 | 8/1994 | Japan . | |

*Primary Examiner*—Gary E. Elkins

*Attorney, Agent, or Firm*—Armstrong, Westerman, Hattori, McLeland & Naughton

[57] ABSTRACT

A heat insulating cup comprises a cup body and a protective cover. The cup body has side wall and a bottom wall. The protective cover is adhered to the cup body to cover the entire outer circumferential region of the side wall. The upper end portion of the side wall is folded outward along the open upper circumferential edge of the cup body to form a flange portion. The protective cover comprises an embossed paper sheet having a dotted pattern of embossed points and a paper liner board adhered to the embossed paper sheet. The embossed paper sheet has a basis weight of 50 to 180 g/m$^2$, with the liner board having a basis weight of 180 to 270 g/m$^2$. A laminate structure prepared by adhering the liner board to the embossed paper sheet is die-cut to prepare a blank of the protective cover. The blank is adhered to the side wall of the cup body such that the both side end regions of the wound blank are arranged opposite each other.

20 Claims, 8 Drawing Sheets

HEAT INSULATING CUP AND METHOD OF MANUFACTURING THE SAME

This application is a continuation-in-part of application Ser. No. 08/451,322 filed May 26, 1995, now abandoned.

BACKGROUND OF THE INVENTION

1. Field of the Invention

The present invention relates to a heat insulating cup consisting of a cup body and a protective cover attached to the cup body, particularly, to a heat insulating cup containing a so-called "instant-cooking food" or beverage which can be cooked by simply pouring a hot water thereinto.

2. Description of the Related Art

A known heat insulating cup comprises a paper cup body and a paper protective cover of a heat insulating structure surrounding the cup body. The cup of this type can be readily disposed of when discarded. Also, the cup materials can be used again, if necessary.

A cup comprising a cup body and a corrugated board attached to the cup body to surround it is disclosed in, for example, Jpn. UM Appln. KOKAI Publication No. 50-27080, said corrugated board comprising two liner boards, i.e., thick sheets, and a corrugated paper sheet sandwiched between these liner boards. In this prior art, it is necessary to form the two liner boards, which are tough, in truncated cone shapes differing from each other in the circumferential length such that the corrugated board would smoothly conform with the shape of the cup body. The requirement for the particular shapes leads to a troublesome operation for preparing the liner boards. In addition, the corrugated board tends to elastically peel off the cup body. If an external force exceeding an elastic limit is applied to the corrugated board, the liner boards of the corrugated board are wrinkled so as to impair the appearance of the cup.

Technique for overcoming the above-noted problems is disclosed in, for example, Jpn. Pat. Appln. KOKAI Publication No. 54-1178. It is disclosed that a large number of cuts are imparted to the outer liner board of a corrugated board so as to facilitate the winding of the corrugated board into a cylindrical shape. However, the cylindrical body thus formed is rendered poor in its heat insulating property. In addition, the appearance of the cylindrical body is not satisfactory.

SUMMARY OF THE INVENTION

An object of the present invention is to provide a heat insulating cup adapted for mass production at a low cost.

Another object is to provide a heat insulating cup exhibiting a good outer appearance.

Another object is to provide a heat insulating cup in which a protective cover is strongly adhered to a cup body.

Another object is to provide a heat insulating cup exhibiting a low feeling temperature when the cup containing hot contents is held by a person.

Another object is to provide a heat insulating cup whose surface effectively prevents human fingers from slipping when the cup is held by a person.

Still another object is to provide a heat insulating cup which can be released easily when a plurality of cups are telescopically superposed one upon the other.

According to a first aspect of the present invention, there is provided a method of manufacturing a heat insulating cup comprising a cup body having a paper side wall and a paper bottom wall and a paper protective cover attached to cover the side wall of the cup body, the protective cover consisting of an embossed paper sheet and a paper liner board adhered to the embossed paper sheet, the method comprising the steps of:

adhering a first raw material sheet of the embossed paper sheet and a second raw material sheet of the liner board each other with a first adhesive;

die-cutting the adhered structure of the first and second raw material sheets to prepare a blank of the protective cover; and winding the blank such that the liner board is positioned outside and subsequently adhering the wound blank to the side wall of the cup body with a second adhesive.

According to a second aspect of the present invention, there is provided a heat insulating cup comprising of a cup body having a paper side wall and a paper bottom wall and a paper protective cover attached to cover the side wall of the cup body, wherein the protective cover is prepared by winding a blank of a multi-layer structure including an embossed paper sheet and a paper liner board adhered to the embossed paper sheet, the blank being wound such that the liner board is positioned outside.

According to a third aspect of the present invention, there is provided a heat insulating cup comprising a cup body having a paper side wall and a paper bottom wall and a paper protective cover attached to cover the side wall of the cup body, wherein the protective cover comprises an embossed paper sheet having an embossment formed of embossed dots which have a substantially uniform depth entirely.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
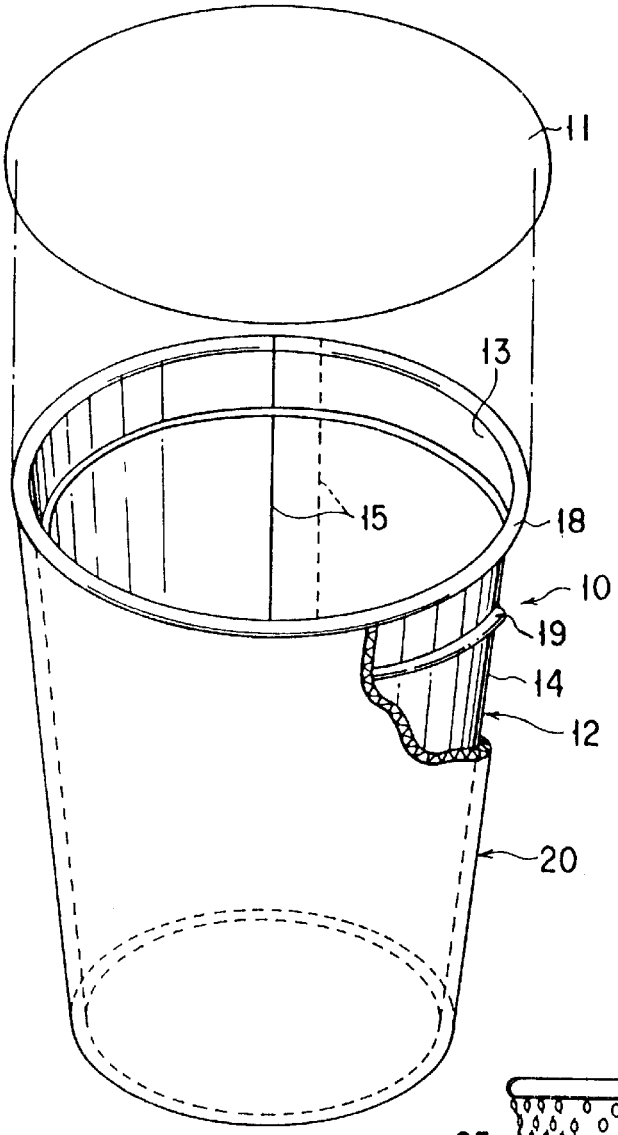
FIG. 1 is a perspective view, partly broken away, showing a heat insulating cup according to one embodiment of the present invention together with a lid shown away from the cup.
Figure 2:
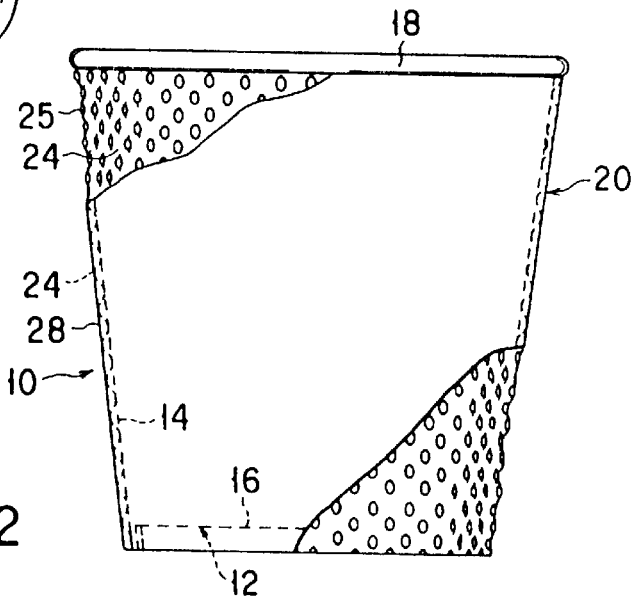
FIG. 2 is a front view, partly broken away, showing the heat insulating cup shown in FIG. 1.

FIG. 1 is a perspective view, partly broken away, showing a heat insulating cup 10 according to one embodiment of the present invention, with FIG. 2 being a front view, partly broken away, showing the heat insulating cup 10 shown in FIG. 1. A lid 11 of the cup 10 is shown in a detached fashion from the cup 10.

The cup 10 comprises a cup body 12 having a paper side wall 14 formed in a truncated cone shape, which is turned upside down, and a bottom wall 16. The side wall 14 is prepared by winding a paper board in a truncated cone shape such that side end portions 15 of the wound paper board are allowed to overlap with each other, followed by adhering the overlapping end portions 15 of the wound paper board to each other. On the other hand, the bottom wall 16 has a short cylindrical leg portion, which is engaged with the lower end portion of the side wall 14. Further, the lower end portion of the side wall 14 is folded inward to have the leg portion of the bottom wall 16 wrapped therein. As a result, the lower end portion of the resultant cup body is sealed.

Figure 19:
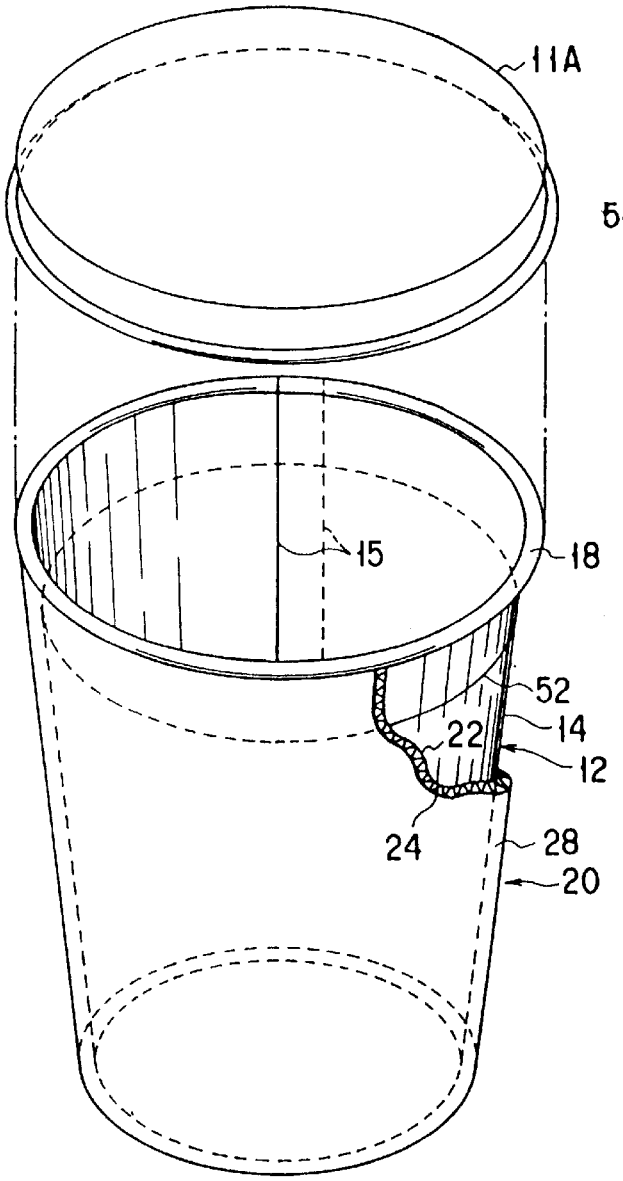
FIG. 19 is a perspective view, partly broken away, showing a heat insulating cup according to another embodiment of the present invention together with a cap shown away from the cup.

The circumferential upper open end portion of the side wall 14 is folded outward such that the folded portion makes at least once complete turn so as to form a flange portion 18 serving to reinforce the cup body 12. The sheet-like lid 11 is attached to the flange portion 18. The lid 11 is made of paper or laminate structure including a paper sheet, e.g. a laminate structure consisting of a paper sheet and an aluminum foil adhered to the paper sheet. An adhesive layer is formed on the lower surface of the lid 11. After loading of contents in the cup body 12, the lid 11 is attached to the flange portion 18 of the side wall 14. It is possible to mount a cap 11A made of a blank of a transparent resin to the flange portion 18 as shown in FIG. 19 in place of using the sheet-like lid 11.

The heat insulating cup 10 also comprises a protective cover 20 covering substantially the entire region of the outer surface of the side wall 14 of the cup body 12. The protective cover 20 is a multi-layer structure comprising an embossed paper sheet 24 attached to cover the entire outer surface of the side wall 14 and a paper liner board 28 attached to cover the entire region of the embossed paper sheet 24.

Figure 3:
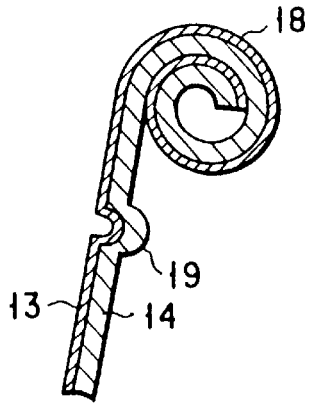
FIG. 3 is a cross sectional view showing the side wall of the cup body included in the heat insulating cup shown in FIG. 1.

Each of the side wall 14 and bottom wall 16 of the cup body 12 is made of a white, high-quality paper board having a basis weight of about 210 g/m$^2$ and a thickness of about 280 $\mu$m. As shown in FIG. 3, a polyethylene film 13 having a thickness of about 45 $\mu$m is formed by coating on the inner surface of the paper board used for forming the side wall 14 of the cup boy 12. Such a polyethylene film is also formed on the inner surface of the paper board used for forming the bottom wall 16. It is desirable for the paper board used for forming the side wall 14 to have a basis weight falling within a range of between 170 g/m$^2$ and 310 g/m$^2$ and a thickness falling within a range of between 220 $\mu$m and 420 $\mu$m. On the other hand, the thickness of the polyethylene film 13 should desirable fall within a range of between 20 $\mu$m and 60 $\mu$m.

The embossed paper sheet 24 is made of a white, bleached kraft paper, and has a basis weight of 120 g/m$^2$. Embossment 25 consisting of a large number of embossed points is formed in the entire region of the embossed paper sheet 24. These embossed points of the embossment 25 are arranged to form first rows extending in a direction making an angle of about 45° with the axis of the cup body 12 and second rows crossing the first rows at substantially the right angles. It is necessary for the embossment 25 not to be collapsed by the ordinary use of the cup 10. Also, the embossed paper sheet 24 is required to be processed easily. In order to meet these requirements, it is desirable for the embossed paper sheet 24 to have a basis weight falling within a range of between 50 g/m$^2$ and 180 g/m$^2$. It should be noted that a bleached kraft paper is made of long fibers and, thus, is unlikely to be broken when an embossing treatment is applied thereto.

To be more specific, the embossed points of the embossment 25 consist of circular projections and circular recesses each having a diameter of about 3.5 mm, and being alternately arranged equidistantly. The whole of the projections and the whole of the recesses are respectively arranged to form lattices extending in directions making an angle of about 45° relative to the axis of the cup body 12 and complimentarily overlapping each other. The density of the embossed points of the embossment 25 including both the projections and recesses is 7/cm$^2$. The height of the embossment 25, which is vertical distance between the top of the projection and the bottom of the recess and which is uniform over the entire region of the embossed paper sheet 24, is set at about 2 mm.

The heat insulating air layer formed within the protective cover 20 is substantially defined by the shape and size of the embossment 25. In view of the desired heat insulating properties of the cup 10, the diameter of the projection and recess forming the embossed points of the embossment 25 should fall within a range of between 2 mm and 5 mm. The height of the embossment 25 should desirably fall within a range of between 1 mm and 5 mm. The density of the embossed points of the embossment 25 should desirably fall within a range of between 3/cm$^2$ and 25/cm$^2$. In the embodiment shown in FIG. 2, the embossment 25 consists of circular projections, i.e., projections each having a circular cross section, and circular recesses. In addition, it is possible for the embossment 25 to consist of rectangular projections and rectangular recesses sized substantially equal to the circular projections and circular recesses described previously. Further, a wave pattern can be used in place of projections and recesses formed in the embossed paper sheet 24.

Figure 4:
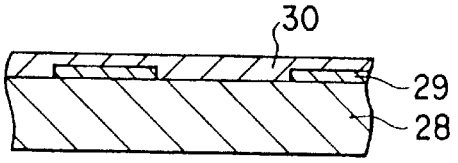
FIG. 4 is a cross sectional view showing the liner board used in the heat insulating cup shown in FIG. 1.

The paper liner board 28 has a basis weight of 230 g/m$^2$. Letters or patterns designating a trade name or the like are indicated on the front surface of the liner board 28 by means of off-set or gravure printing. It is desirable for the liner board 28 to have a basis weight falling within a range of between 180 g/m$^2$ and 270 g/m$^2$. If the basis weight exceeds the upper limit of 270 g/m$^2$, the liner board 28 is rendered unduly rigid, making it troublesome to handle the liner board for preparing the protective cover 20. On the other hand, if the basis weight is lower than the lower limit of 180 g/m$^2$, the rigidity and mechanical strength of the liner board 28 are lowered. As a result, projections and recesses conforming with the embossment 25 are formed on the surface of the liner board. Further, the protective cover 20 mounted to the cup body 12 is likely to be broken during transfer of storage of the heat insulating cup 10. As shown in FIG. 4, ink layers 29 for denoting letters or patterns are formed on the liner board 28. Further, a varnish layer 30 is formed in a thickness of between 3 $\mu$m and 15 $\mu$m to over the entire surface of the liner board 28. The surface of the varnish layer 30, which is made of, for example, an OP (over-printing) varnish, a peeling varnish, etc., is finished smooth.

The cup body 12, embossed paper sheet 24 and liner board 28 are adhered to each other with synthetic adhesives including, for example, vinyl acetate type adhesive, and ethylene vinyl acetate (EVA) type adhesive. It is possible to use various other known adhesives, e.g., a starch type adhesive. However, in the case of using a starch type adhesive, projections and recesses conforming with the embossment 25 are likely to be formed on the surface of the liner board 28. Such being the situation, it is particularly desirable to use the vinyl acetate type adhesive and ethylene vinyl acetate (EVA) type adhesive for adhering the liner board 28 to the embossed paper sheet 24.

Figure 5:
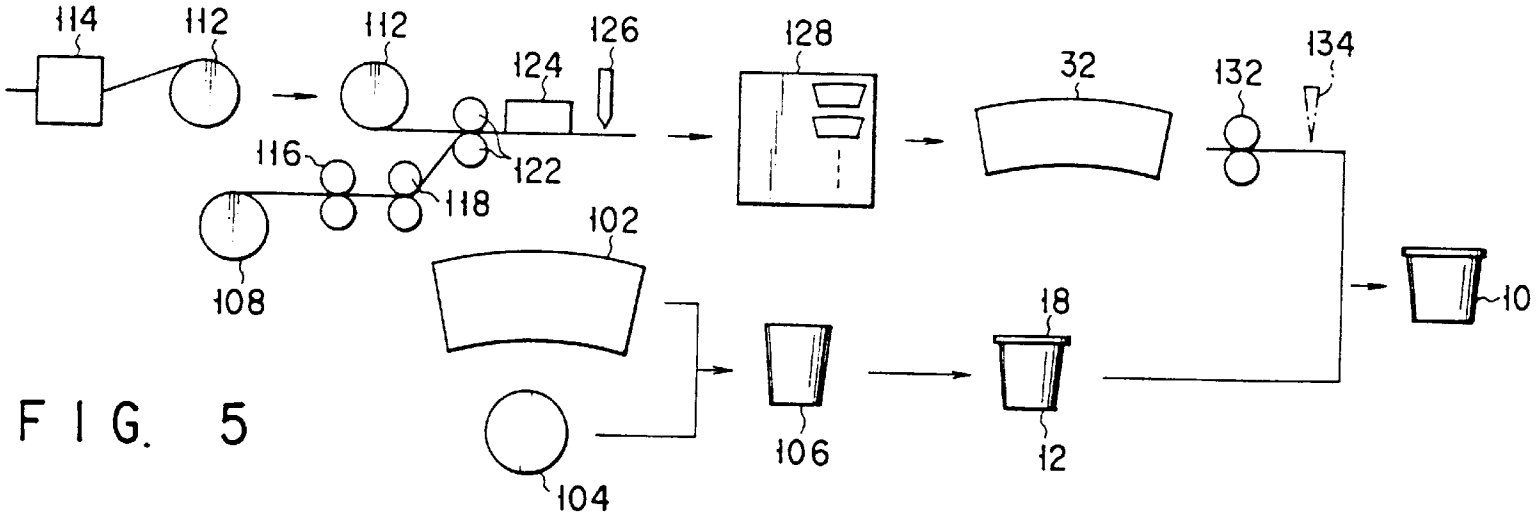
FIG. 5 is a flow chart showing the process of manufacturing the heat insulating cup shown in FIG. 1.

FIG. 5 shows a process of manufacturing the heat insulating cup shown in FIGS. 1 and 2. A known cup-forming apparatus is used for preparing the cup body 12. In the first step, a sectoral sheet 102 is wound in a truncated cone shape to form the side wall 14. On the other hand, a circular sheet 104 is wound along its periphery to form the bottom wall 16. These side wall 14 and bottom wall 16 are combined to form a master form 106 of the cup body 12, followed by folding outward, or curling, the open upper end portion of the cup body 12 to form the flange portion 18. Then, an annular embossed line or mark 19 is formed along the outer circumferential surface of the side wall 14. The annular embossed line 19 is used as a marking when a liquid such as hot water is poured into the cup.

On the other hand, the protective cover 20 is prepared by a system including a known roll embossing apparatus, a known combining machine and a known die-cutting apparatus. Specifically, a sheet roll 108 of a white, bleached kraft paper used as a base paper of the embossed paper sheet 24 and a sheet roll 112 of the liner board 28 are set in the system. A gravure printing and varnish coating is applied in advance to the surface of the raw material sheet of the liner board 28 by using a printer 114, etc. By this printing, letters or patterns denoting the trade name, etc. are imparted to the surface of the raw material sheet of the liner board 28.

The bleached kraft paper sheet released from the sheet roll 108 is embossed by an embossing roller 116 to prepare a raw material sheet of the embossed paper sheet. Then, one surface of the raw material sheet is supplied with an adhesive, e.g., vinyl acetate type adhesive, by an application roller 118. In the embodiment shown in FIG. 5, the adhesive application is performed after the embossing treatment. However, it is possible to carry out the adhesive application simultaneously with the embossing treatment.

A sheet is released from the sheet roll 112 for the liner board 28 in synchronism with the release of the bleached kraft paper sheet such that the released liner board 28 is superposed on the adhesive-applied surface of the raw material sheet of the embossed paper sheet 24. Under this condition, the raw material sheet of the liner board 28 is adhered to the raw material sheet of the embossed paper sheet 24 by a pair of clearance rollers 122 and a pressing belt 124. A predetermined clearance is provided between the paired rollers 122. Also, a spring force is applied to one of these rollers such that the one roller is elastically movable toward the other roller. Because of the particular construction, the liner board and the embossed paper sheet can be adhered to each other without collapsing the embossment 25 formed on the surface of the embossed paper sheet.

The raw material sheets of the embossed paper sheet 24 and the liner board 28 adhered to each other is cut by a cutter 126 into intermediates 128 each having a predetermined width. Then, these intermediates 128 are successively die-cut in conformity with the letters or patterns printed on the liner board 28 so as to obtain a sectoral blank 32 of the protective cover 20, the blank 32 having a size conforming with the size of the circumferential side surface of the cup body 12. In the manufacturing process shown in FIG. 5, it is possible to omit the step of forming the intermediates 128 such that the sectoral blank 32 of the protective cover 20 can be directly prepared by die-cutting.

The blank 32 is, then, supplied with an adhesive, e.g., an ethylene vinyl acetate type adhesive, by an application roller 132. Further, the adhesive-applied blank 32 is attached to the side wall 14 of the cup body 12 so as to form the heat insulating cup 10 comprising the cup body 10 and the protective cover 20. The adhesive-applied blank 32 can be attached to the side wall 14 by using a winding apparatus. In this case, the blank 32 is adhered by the adhesive to the side wall 14 during the winding process of the blank 32 about the side wall 14 of the cup body 12. The winding method permits the side end portions of the blank 32 not to overlap each other but to butt against each other in adhering the blank 32 to the side wall 14.

A fitting method can be employed in place of the winding method for attaching the blank 32 of the protective cover 20 to the side wall 14 of the cup body 12. In the fitting method, the blank 32 is wound in advance into a truncated cone shape substantially conforming with the side wall 14 of the cup body 12, followed by fitting the wound blank 32 over the side wall 14. In this fitting step, the blank 32 is adhered by an adhesive to the side wall 14 of the cup body 12. The blank 32 of the protective cover 20 is provided with an adhesive-application space or marginal portion, to which an adhesive is applied, at one side end portion as described herein later, with the result that the side end portions of the protective cover 20 are allowed to overlap each other.

An adhesive may be applied to the entire region on the back surface of the blank 32 for attaching the protective cover 20 to the cup body 12. It is also possible to apply the adhesive selectively to band-like side end regions of the blank 32. Further, it is desirable to apply the adhesive to the blank 32 as shown in FIG. 6.

Figure 6:
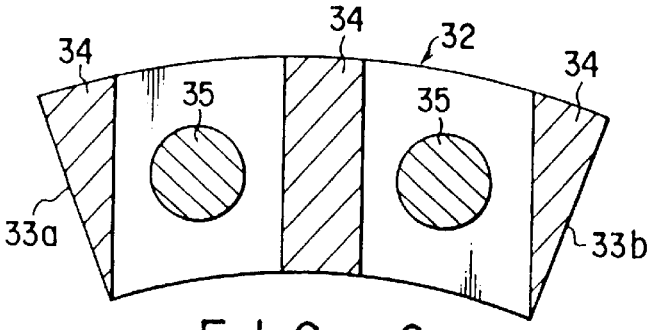
FIG. 6 is a plan view showing how an adhesive is applied to a blank of the protective cover.

FIG. 6 shows that the blank 32 includes three band-like first regions 34 to which an adhesive is applied with a pressure by an application roller, said first regions 34 consisting of two side end regions 34 in the vicinity of first and second side ends 33*a*, 33*b* and a central region 34. The blank 32 also includes two second regions 35 to which an adhesive is applied without a pressure by a spray, the two second regions 35 being interposed between the three first regions 34. The protective cover 20 is adhered by these adhesive to the side wall 14 of the cup body 12. These adhesives applied to the first and second regions 34 and 35 may be the same adhesive, e.g., an ethylene vinyl acetate adhesive, differ from each other in the application amount.

As described above, the three first regions 34 of the blank of the protective cover 20 shown in FIG. 6 are supplied with the adhesive in a pressurized state. Also, the two second regions 35 are supplied with the adhesive in a non-pressurized state and in an amount smaller than the application amount to the first regions 34. As a result, the amount of the adhesive consumption can be decreased. Also, it is possible to avoid various problems such as deformation of the cup body 12, the protective cover 20, etc. and the peeling at the side end portion of the protective cover 20, which are caused by the shrinkage of the adhesive when the adhesive is dried. Further, the heat transmission via the adhesive layer to the outer surface of the protective cover 20 can be diminished in the region other than the first regions 34 so as to lower the feeling temperature of the heat insulating cup 10 felt by the user. What should also be noted is that the protective cover 20 is adhered to the cup body 12 by the second regions 35 interposed between the three first regions 34, with the result that the protective cover 20 is prevented from floating or being deviated. It follows that the present invention permits solving various problems that the heat insulating cup is felt unreliable when held by the user, that the surface roughness is likely to occur on the protective cover 20, and that the protective cover 20 tends to be detached from the cup body 12 when the adhesive is once peeled.

FIG. 5 shows that an adhesive spray 134 is disposed downstream of the application roller 132. In this embodiment, the three first regions 34 of the blank 32 are supplied with an adhesive by the roller 132, followed by spraying an adhesive against the second regions 35 by the spray 134. As described previously, these adhesive applied to first and second regions, which may be the same adhesive, e.g., an ethylene vinyl acetate adhesive, differ from each other in the application amount. For example, in terms of the adhesive concentration the application step, the application amount to the first regions 34 should fall within a range of between 0.1 g/cm$^2$ and 0.5 g/cm$^2$, while the application amount to the second regions 35 should fall within a range of between 0.005 g/cm$^2$ and 0.1 g/cm$^2$. It is necessary to set the application amount to the first regions 34 at a certain amount, but is desirable to make the application amount to the second regions 35 small. Where the application amount to the second regions 35 is too large, the protective cover 20 is apt to be wrinkled so as to impair the adhering between the cup body 12 and the protective cover 20.

As described above, the application roller 132 and the application spray 134 are used for applying the adhesives to the first and second regions 34 and 35, respectively, of the blank 32, making it possible to supply these regions 34 and 35 with desired amounts, differing from each other, of the adhesives. These adhesives of the first and second regions are generally applied to the blank 32 in different steps, but are applied substantially consecutively, with the result that the through-put of the heat insulating cup is not substantially lowered.

Figure 7:
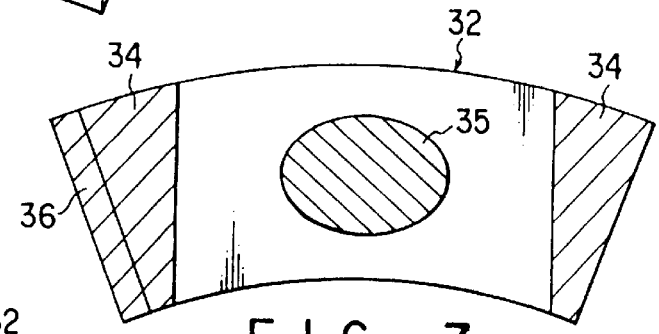
FIG. 7 is a plan view showing a modification of the blank of a protective sheet and also showing how an adhesive is applied to the blank.

FIG. 7 shows a blank 32 having an adhesive-application space or a marginal portion 36 to be supplied with an adhesive and be overlapped. In addition, the first and second regions 34 and 35 are arranged in manners different from those shown in FIG. 6. The first band-like regions 34 are positioned at the side end portions, and the second oblong region 35, which is laterally elongated, is positioned substantially at the center of the blank 32. These two first regions 34 are supplied with an adhesive by the application roller 132, with the second oblong region 35 being supplied with an adhesive by the spray 134.

Figure 8:
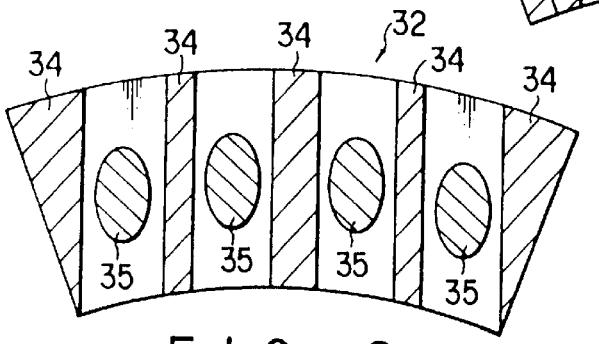
FIG. 8 is a plan view showing a modified manner of applying an adhesive to a blank of a protective sheet.

FIG. 8 shows another modification of the blank 32. In this case, the blank 32 comprises five first regions 34 including two triangular regions at the side end portions and three band-like regions in the central portion. The blank 32 also comprises four oblong second regions 35, which are vertically elongated and positioned between the adjacent first regions 34. These first and second regions 34 and 35 are supplied with adhesives by the application roller 132 and the spray 134, respectively.

As apparent from FIGS. 7 and 8, it is possible to modify in various fashions the number, positions and shapes of the first and second regions, respectively. However, it is necessary for the first regions to include band-like regions at the side ends of the blank 32. Also, it is desirable for the second region to be positioned in substantially the central region sandwiched between adjacent first regions.

As another modification, it is possible to apply an adhesive with a pressure to the inner surface of the blank 32 by an application roller, and to apply an adhesive without a pressure to the outer surface of the side wall 14 by a spray, thereby attaching the protective cover 20 to the side wall 14 with these adhesives. In this case, it is necessary for the first regions, on which an adhesive is applied with a pressure by an application roller, to include band-like regions at the side ends of the blank 32. The second region, on which an adhesive is applied without a pressure by a spray, may be the entirety of the outer surface of the side wall 14, or a selected portion or portions thereof. Where the second region consists of a selected portion or portions of the outer surface of the side wall 14, it is desirable for the second region to be selected to correspond to the central position between the first regions, as the second regions 35 on the blank 32 shown in FIGS. 6, 7 and 8.

In this modification, since an adhesive is applied to the side wall 14 of the cup body 12 without a pressure by a spray, the adhesive can be uniformly applied to a selected position on the side wall 14 with a predetermined application amount, regardless of the curved surface of the side wall 14.

Figure 9:
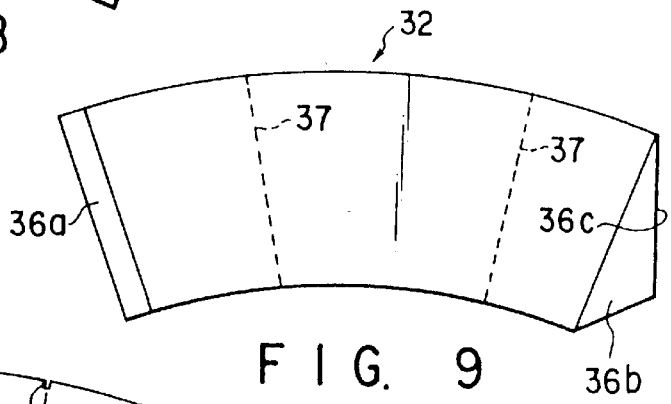
FIG. 9 is a plan view showing a modification of a blank of a protective sheet.

FIG. 9 shows another modification of the blank 32 of the protective cover 20, which is assembled in advance into a cylinder of a truncated cone shape and is fit over and adhered to the outer surface of the cup body. In this case, the blank 32 comprises adhesive-application spaces 36*a* and 36*b* at the side end portions. The adhesive-application space 36*a* is equal in its shape and function to the adhesive-application space 36 shown in FIG. 7. The adhesive-application space 36*b* is also coated with an adhesive. In addition, the adhesive-coating space 36*b* allows a side 36*c* of the blank 32 to abut against a conveyor guide in the step of transferring the blank 32, with the result that the blank 32 is held perpendicular to its transferring direction.

Further, the blank 32 shown in FIG. 9 comprises two straight perforations 37 each extending across the width of the blank 32. Incidentally, the upper and lower arcs of the blank 32 are concentric. As apparent from the drawing, each of these two perforations 37 extends toward the center of the two concentric circles including the upper and lower arcs of the blank 32. These two perforations 37 are arranged substantially equidistant from the center of the blank 32. Each hole of these perforations 37 extends through both the embossed paper sheet 24 and the liner board 28 so as to lower the rigidity of the blank 32 and to give directionality in the step of winding the blank 32. In other words, the perforation 37 permits the blank 32 to be wound easily and as desired in the step of forming the protective cover 20 around the side wall 14 of the cup body 12. It is important to determine appropriately the size of the hole and distance between adjacent holes of the perforation 37 in order to prevent the blank 32 from being broken when wound to prepare the protective cover 20. Specifically, the size of the hole and the distance between adjacent holes of the perforation 37 should be set at 5 mm to 8 mm. The perforation 37 can be formed in the die-cutting step for preparing the blank 32. An experiment was conducted in order to look into the effect produced by the perforation 37, as follows. In this experiment, prepared were samples 1 to 5 of the blank 32, said samples differing from each other in the type of a folding line, so as to measure the folding strength of the sample along the folding line. Also measured were treatability and finished state in folding the blank 32 for preparing the protective cover 20. The experimental conditions and results are shown in Table 1. Sample 1 shown in Table 1 corresponds to the blank 32 shown in FIG. 9. The perforation 37 in Sample 1 consisted of holes each sized 5 mm and arranged 5 mm apart from each other. For forming the perforation 37, die-cutting was applied on the side of the liner board 28 of the blank 32. Samples 2 to 5 shown in Table 1 denote control cases. In these samples, the folding lines were formed as shown in Table 1. Specifically, the term "Ruled Line 1" denotes a groove 1.0 mm wide. The term "Back Cut" denotes a groove formed by cutting the embossed paper sheet 24 alone with a cutter blade. Further, the term "Ruled Line 2" denotes a groove of a small width formed by a cutter blade. It should be noted that, in forming the folding lines, working tools were applied in different directions in preparing Samples 1 to 5. Concerning the working direction shown in Table 1, the term "Front" denotes that a working tool was put in direct contact with the liner board 28 when the working was started, with the term "Back" denoting that the working tool was put in direct contact with the embossed paper sheet 24 when the working was started. Each of the treatability and finished state was evaluated by "O" denoting "good", "Δ" denoting "fair", and "X" denoting "poor".

TABLE 1

| Sample | Working Direction | Folding Line | Treatability | Finished State | Folding Strength (g) |
|---|---|---|---|---|---|
| 1 | Front | Perforation | 0 | 0 | 64 |
| 2 | Back | Ruled Line 1 | X | X | 69 |
| 3 | Front | Ruled Line 1 | X | X | 79 |
| 4 | Back | Back Cut and Ruled Line 2 | Δ | 0 | 66 |
| 5 | Back | Back Cut | X | 0 | 74 |

Table 1 clearly shows that Sample 1 was superior to Samples 2 to 5 in any of the folding strength, workability and finished state.

Figure 10:
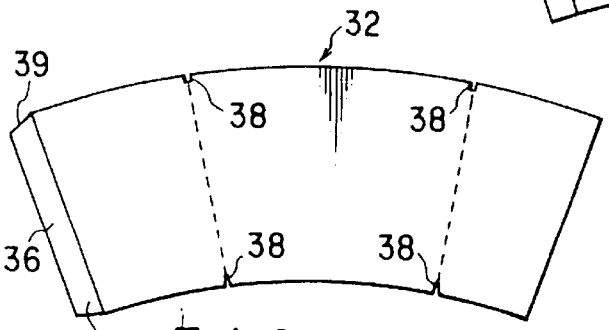
FIG. 10 is a plan view showing another modification of a blank of a protective sheet.

FIG. 10 shows still another modification of the blank 32 of the protective cover 20 shown in FIG. 9. In this case, a cut-out 38 is formed at each of the upper and lower ends of each of the two perforations 37 so as to facilitate the winding of the blank 32 along these perforations 37. Of course, the presence of these cut-outs 38 serves to ensure the winding of the blank 32. Desirably, the cut-outs 38 should be about 3 mm long. These cut-outs 38 can be formed in the die-cutting step of the blank 32 together with the perforation 37.

The blank 32 shown in FIG. 10 also comprises an adhesive-application space 36. The upper and lower ends of the space 36 are defined by oblique sides 39 each inclined by about 15° relative to the upper or lower arc of the blank 32. Where these oblique sides 39 are inclined as shown in FIG. 10, the adhesive-application space 36 is unlikely to be exposed to the surface even if the blank 32 is wound to form a truncated cone shape which is somewhat deviant from the predetermined shape. In other words, the presence of the space 36 makes it possible to prevent the appearance of the resultant protective cover 20 from being impaired even if winding of the blank 32 is somewhat unsatisfactory.

Figure 11:
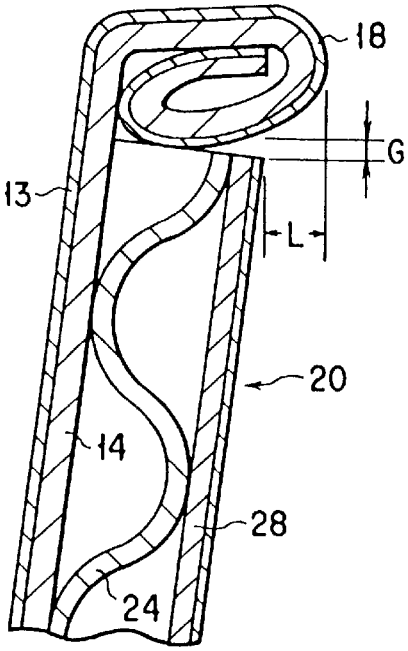
FIG. 11 is a cross sectional view showing a modification of a flange portion of the heat insulating cup shown in FIG. 1.

FIG. 11 is a cross sectional view showing a modification of the flange portion 18. In this modification, the upper end portion of the side wall 14 of the cup body 12 is folded outward and curled to make at least about one complete turn. Then, the curled portion is crushed by pressing in a vertical direction such that the curled portion may be flattened. The inner surface of the flange portion 18 is not in an adhesive condition, and the self-restoring force of the flange portion 18 causes the lower surface of the flange portion 18 to abut against an upper end portion 20*a* of the protective cover 20. As a result, the flange portion 18 is prevented from being further deformed by its self-restoring force. It should also be noted that a gap G appearing on the outer surface of the protective cover 20 between the upper end of the protective cover 20 and the lower end of the flange portion 18 is decreased to 0.5 mm or less.

In the conventional heat-insulating cup, a gap of at least about 1.0 mm is formed between the protective cover and the flange portion of the cup body because of the requirement of operating a tool for mounting the protective cover to the cup body. The large gap noted above is likely to catch a cup handling arm. In the modification shown in FIG. 11, however, the gap in question is decreased to 0.5 mm or less so as to eliminate the above-noted trouble.

The flange portion 18 is caused by pressing in a vertical direction so as to have a flat surface. As a result, the area of the flat surface, which is brought into contact with the lid 11, of the flange portion 18 is increased so as to ensure satisfactory sealing properties. In addition, even if the curled portion before formation of the flange portion 18 has the same size, the overhanging length L of the flange portion 18 from the protective cover 20 is increased, compared with the case where the curled portion is not crushed. It follows that the heat-insulating cup is prevented from being dropped from a conveyor holder of the transferring apparatus. In this modification, the overhanging length L is set to fall within a range of between 1.5 mm and 2.5 mm.

Figure 12A:
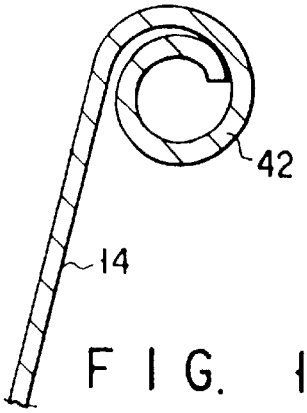
FIGS. 12A and 12D collectively show a process of forming the flange portion shown in FIG. 11.
Figure 15:
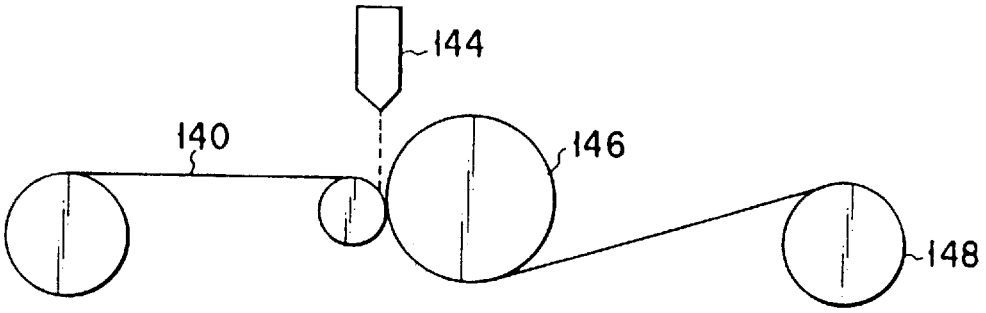
FIG. 15 shows a process of manufacturing a raw material sheet used for forming the side wall shown in FIG. 14.

FIGS. 12A to 12D collectively show to form the flange portion 18 shown in FIG. 11. Specifically, after formation of the master form 106 of the cup body 12 as shown in FIG. 15 the side wall 14 of the cup body 12 is folded outward along its open upper peripheral region and, then, wound to make at least one complete turn to form a curled portion 42, as shown in FIG. 12A.

Figure 12B:
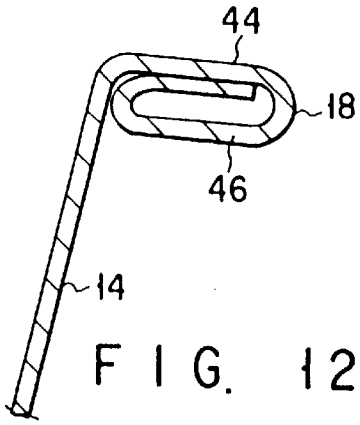
Figure 14:
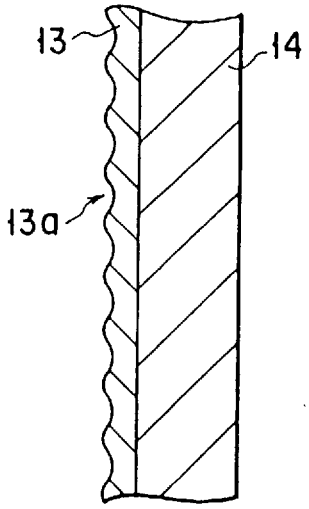
FIG. 14 is a cross sectional view showing a modification of the side wall of the cup body.

In the next step, the curled portion 42 is flattened by crushing under heat and pressure so as to form the flange portion 18 having an upper plate 44 and a lower plate 46, as shown in FIG. 12B. In this step, the curled portion 42 is not crushed completely. To be more specific, a free space should be provided within the flange portion 18. In addition, the upper plate 44 and the lower plate 46 should not be adhered to each other. In this embodiment, the inner surface alone of the side wall 14 is coated with a polyethylene film 13, as shown in FIG. 14. It follows that, even if the curled portion 42 is completely crushed, the upper plate 44 is not adhered to the lower plate 46. Also, the tip of the curled portion 42 is not adhered to the upper portion of the side wall 14. However, it is desirable for the curled portion 42 not to be crushed completely because the self-restoring force of the flange portion 18 is utilized in the subsequent step.

Figure 12C:
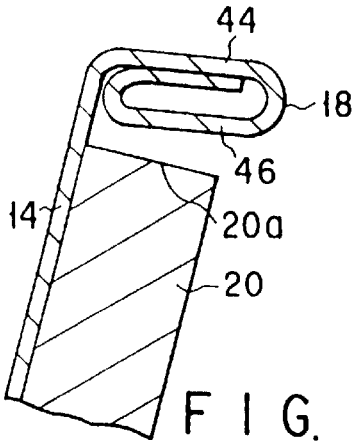
Figure 12D:
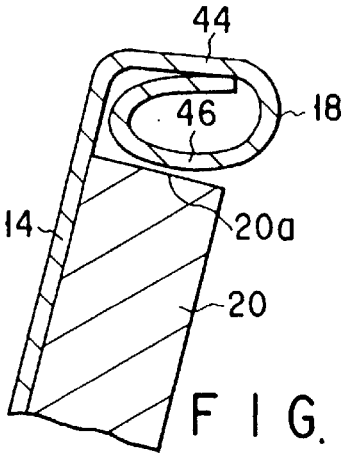

Immediately after crushing of the curled portion 42, the protective cover 20 is adhered to the side wall 14 of the cup body 12, as shown in FIG. 12C. As described previously, the upper plate 44 and the lower plate 46 are not adhered to each other within the flange portion 18, with the result that the flange portion 18 is caused by its self-restoring force to be deformed back into the original shape of the curled portion 42, as shown in FIG. 12D. In other words, the lower plate 46 is deformed toward the upper edge 20*a* of the protective cover 20 so as to decrease the width of a gap appearing along the outer surface of the protective cover 20 between the protective cover 20 and the flange portion 18. Desirably, the flange portion should be deformed to cause the lower plate 46 to abut against the upper edge 20*a* of the protective cover 20, as shown in FIG. 11, so as to prevent the flange portion 18 from being further deformed by its self-restoring force.

As described above, the flange portion 18 is formed by crushing flat the curled portion 42 so as to increase the contact area between the lid 11 and the flange portion 18 and, thus, to increase the overhanging length of the flange portion 18 from the edge of the protective cover 20. Further, the width of the gap G between the protective cover 20 and the flange portion 18 can be decreased to a desired value of 0.5 mm or less by utilizing the self-restoring force of the flange portion 18. For utilizing the self-restoring force of the flange portion 18, it is important to select appropriately the position of the upper edge 20*a* of the protective cover 20 and the material of the side wall 14. It is also important to prevent the upper plate 44 and the lower plate 46 of the flange portion 18 from being adhered to each other.

Figure 13:
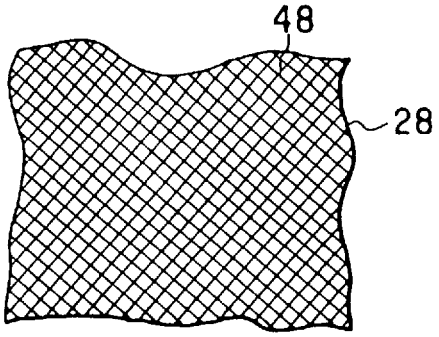
FIG. 13 is a plan view showing a modification of a liner board.

FIG. 13 is a plan view showing the surface of the liner board 28 according to a modification of the present invention. In this modification, a surface embossment 48 consisting of projected and recessed lattice pattern is formed on the entire outer surface of the liner board 28. The lattice pattern of the embossment 48 is defined by a large number of grooves including first grooves extending in a direction making an angle of about 45° with the axis of the cup body 12 and second grooves crossing the first grooves at substantially right angles. The average distance between the first grooves and between the second grooves is about 1 mm. In other words, the average width of the lattice element is set at about 1 mm. Further, the embossment 48 has an average roughness, defined by ten points mean roughness (JIS B 0601), of about 54 $\mu$m.

The raw material sheet of the liner board 28 passing through the printer 114 shown in FIG. 5 is further passed through an embossing roll for forming the embossment 48 thereon. After formation of the embossment 48, the raw material sheet roll 112 of the liner board 28 is set in an apparatus for adhering the embossed liner board 24 to the raw material sheet.

It is desirable for the embossment 48 to have the average width of the lattice element falling within a range of between 500 $\mu$m and 1500 $\mu$m. Also, the average roughness, defined by the ten points mean roughness, of the embossment 48 should desirably fall within a range of between 40 $\mu$m and 100 $\mu$m, with the greatest roughness less than 120 $\mu$m. If the lattice width and the surface roughness noted above are greater than the upper limits noted above, the letters or patterns put on the outer surface of the heat insulating-cup are unlikely to be recognized easily and clearly. By contraries, if the lattice width and the surface roughness are smaller than the lower limits of the ranges noted above, the effective temperature of the heat-insulating cup is felt higher by the user. In addition, the surface of the cup tends to cause slipping. Incidentally, patterns other than the embossment 48 can be formed on the surface of the liner board 28. For example, a so-called "dot-pattern" consisting of a large number of projections and recesses, each being substantially equal in size to the lattice element in the embossment 48, can be formed on the surface of the liner board 28.

In the case of using the modified liner board 28 described above, the protective cover 20 consists of the embossed paper sheet 24 having the embossment 25 of the large points and the liner board 28 having the embossment 48 of the lattice pattern formed thereon, said liner board 28 covering the outer surface of the embossed paper sheet 24. The particular construction permits the letters or patterns formed on the outer surface of the protective cover 20 to be visually recognized easily and accurately. Also, the surface of the protective cover 20 is unlikely to slip when held by the user. Further, the large embossed points of the embossment 25 formed in the embossed paper sheet 24 serve to effectively suppress the heat transmission to the outer surface of the protective cover 20. In addition, the small embossed lattice pattern of the embossment 48 formed on the liner board 28 serve to lower the effective temperature of the heat-insulating cup, which is felt by the user when the cup is held.

FIG. 14 is a cross sectional view showing a modification of the side wall 14 of the cup body 10. In this modification, a matting treatment is applied to the polyethylene film 13 covering the inner surface of the side wall 14 so as to form a matted surface 13*a*. The matted surface should have an average roughness, defined by the ten points mean roughness (JIS B 0601), of 10 $\mu$m to 30 $\mu$m. If the average roughness of the matted surface is smaller than the lower limit of the above-noted range, blocking is likely to take place. On the other hand, if the average roughness noted above is larger than the upper limit of the range noted above, the matting treatment itself is rendered difficult. The average roughness, defined by the ten points mean roughness, of the matted surface should not be larger than 60% of the thickness of the polyethylene film 13. Otherwise, pin holes tend to be formed in the polyethylene film 13, leading to a low reliability in resistance to water permeation. Incidentally, other resin films which can be heat-sealed such as a polyester film can be used in place of the polyethylene film 13.

In the modification shown in FIG. 14, the inner surface of the side wall 14 of the cup body 12 is covered with a plastic layer such as the polyethylene film 13 having a relatively rough surface, i.e., a roughness, defined by the ten points mean roughness, of 10 $\mu$m to 30 $\mu$m. As a result, even if a large number of heat insulating cups are telescopically superposed one upon the other, the individual cups can be released easily from the superposed arrangement in spite of the fact that the protective cover 20 has a high elasticity. If the outer surface of the liner board 28 is covered with a varnish layer, the release of the individual cups from the superposed arrangement can be further facilitated. Further, the plastic layer should have a roughness, defined by the ten points mean roughness, which should not be larger than 60% of the thickness of the plastic layer, so as to prevent pin holes from being formed in the plastic layer.

Experiments were conducted in order to confirm the effect produced by the matting treatment and to look into the relationship between the matting treatment applied to the surface of the polyethylene film 13 and the varnish layer formed to cover the outer surface of the liner board 28. In these experiments, the static frictional force and coefficient of static friction between a polyethylene film having a matted surface and a varnish layer having smooth surface were measured on the basis of JIS K 7125. Table 2 shows experimental data of Samples A–D used in these experiments. In Table 2, "Roughness" denotes the ten points mean roughness of the polyethylene film, and "Varnish Layer" denotes a type of the varnish layer. Samples A and B were prepared to correspond to the side wall 14 shown in FIG. 14, while samples C and D were prepared to have a less matted surface, static frictional forces (gf) and coefficients of static friction measured in the experiments are shown in "SFC" and "CSF", respectively, in Table 2.

TABLE 2

| Sample | Roughness ($\mu$m) | Varnish Layer | SFC (gf) | CSF |
|---|---|---|---|---|
| A | 21.9 | Peeling Varnish | 44.45 | 0.222 |
| B | 21.9 | OP Varnish | 46.10 | 0.231 |
| C | 5.0 | Peeling Varnish | 49.00 | 0.245 |
| D | 5.0 | OP Varnish | 54.25 | 0.271 |

As apparent from Table 2, the coefficient of static friction for Samples A and B is smaller than that for Samples C and D. This clearly supports that the matting treatment applied to the polyethylene film 13 as shown in FIG. 14 permits the individual heat-insulating cups, which are telescopically superposed one upon the other during storage, to be released easily from the superposed arrangement.

FIG. 15 shows how to apply a matting treatment to the polyethylene film 13 formed to cover the side wall 14 of the cup body 12. In the first step, prepared is a raw material sheet of the side wall 14 of the cup body 12. As shown in FIG. 15, a molten polyethylene is supplied from an extruder 144 to the raw material sheet 140 released from a sheet roll 142 to coat the raw material sheet 140 with a polyethylene film. Then, the polyethylene film formed to cover the raw material sheet 140 is cooled with a cooling roller 146 having the surface which has been subjected to a matting treatment. As a result, a matting treatment is applied to the surface of the polyethylene film formed to cover the raw material sheet 140 when the raw material sheet 140 is moved along the surface of the cooling roller 146. Further, the raw material sheet 140 after the cooling and matting treatments is taken up as a sheet roll 148.

Figure 16:
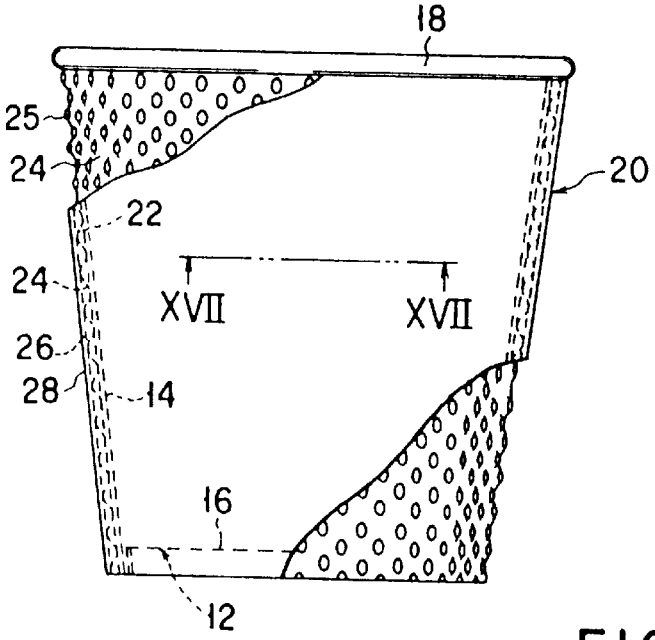
FIG. 16 is a front view, partly broken away, showing a heat insulating cup according to another embodiment of the present invention.
Figure 17A:
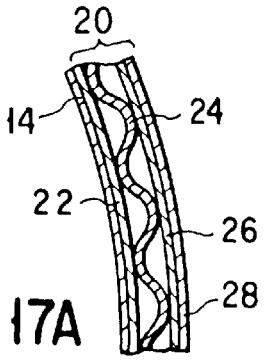
FIGS. 17A and 17B are a cross sectional view along line XVII—XVII shown in FIG. 16 and a cross sectional view showing a modification of the heat insulating cup shown in FIG. 16, respectively.

FIG. 16 is a front view, partly broken away, showing a heat insulating cup according to another embodiment of the present invention, with FIG. 17A being a cross sectional view along line XVII—XVII shown in FIG. 16. The reference numerals which were already explained in conjunction with the embodiment shown in FIGS. 1 and 2 are also used in FIGS. 16 and 17A for denoting the same members of the cup.

In the embodiment shown in FIGS. 16 and 17A, the protective cover 20 is of a multi-layer structure comprising a first thin paper sheet 22 formed to cover the entire outer surface of the side wall 14, the embossed paper sheet 24 formed to cover the entire region of the first thin paper sheet 22, a second thin paper sheet 26 formed to cover the entire region of the embossed paper sheet 24, and the paper liner board 28 formed to cover the entire region of the second thin paper sheet 26.

The embossed paper sheet 24 and the liner board 28, which were already described in conjunction with FIG. 2, are used in the embodiment shown in FIGS. 16 and 17A. The first thin paper sheet 22 is opaque white, exhibits medium duty white roll characteristics, and should have a basis weight of about 30 g/m$^2$. Likewise, the second thin paper sheet 26 is opaque white, exhibits medium duty white roll characteristics, and should have a basis weight of about 30 g/m$^2$.

The first thin paper sheet 22 co-operates with the liner board 28 to prevent the embossed paper sheet 24 from being warped, to improve the adhering strength between the cup body 12 and the protective cover 20, and to facilitate the automatic roll feeding or sheet-by-sheet feeding of the embossed paper sheet 24 so as to improve the productivity of the heat insulating cups. To meet these requirement, the first thin paper sheet 22 is required to exhibit a reasonable mechanical strength and rigidity. To be more specific, the first thin paper sheet 22 is required to have a basis weight falling within a range of between 20 g/m$^2$ and 100 g/m$^2$. If the basis weight exceeds the upper limit of this range, the first thin paper sheet 22 is rendered unduly rigid, leading to a low processibility in preparing the protective cover 20. On the other hand, if the basis weight is lower than the lower limit of the above-noted range, the rigidity and mechanical strength of the first thin paper sheet 22 are rendered unduly low. It follows that the first thin paper sheet 22 is likely to be broken during the manufacturing process of the protective cover 20. Also, the sheet 22 is incapable of sufficiently preventing the embossed paper sheet 24 from being warped.

The second thin paper sheet 26 is intended to prevent the liner board 28 from bearing grooves or the like conforming with projections or the like formed on the surface of the embossed paper sheet 24, to prevent the outer surface of the liner board 28 from bearing traces of adhering so as not to impair the outer appearance, and to facilitate the automatic roll feeding or sheet-by-sheet feeding of the embossed paper sheet 24 so as to improve the productivity of the heat insulating cups. To meet these requirement, the second thin paper sheet 26 is required to exhibit a reasonable mechanical strength and rigidity. To be more specific, the second thin paper sheet 26 is required to have a basis weight falling within a range of between 20 g/m$^2$ and 100 g/m$^2$. If the basis weight exceeds the upper limit of this range, the second thin paper sheet 26 is rendered unduly rigid, leading to a low processibility in preparing the protective cover 20. On the other hand, if the basis weight is lower than the lower limit of the above-noted range, the rigidity and mechanical strength of the second thin paper sheet 26 are rendered unduly low. It follows that the second thin paper sheet 26 is likely to be broken during the manufacturing process of the protective cover 20.

Figure 18:
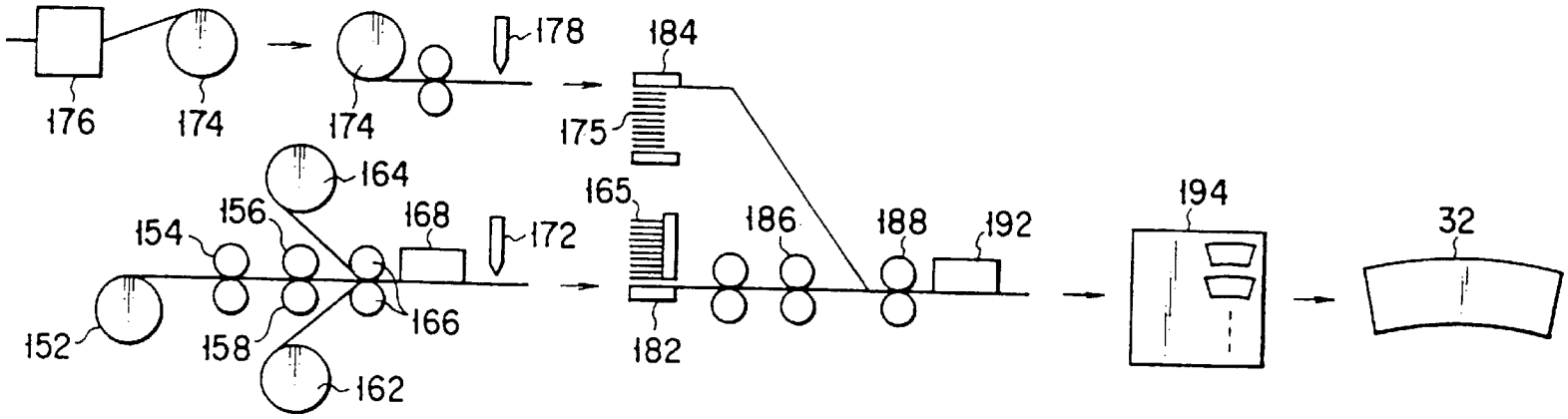
FIG. 18 shows a process of manufacturing the heat insulating cup shown in FIG. 16.

FIG. 18 shows how to manufacture the protective cover included in the heat insulating cup shown in FIG. 16. In the first step, an embossing treatment is applied to a white, bleached kraft paper sheet released from a sheet roll 152 so as to prepare a raw material sheet of the embossed paper sheet 24 bearing the embossment 25. Then, the both surfaces of the raw material sheet of the embossed paper sheet 24 are supplied with an adhesive, e.g., vinyl acetate type adhesive, by pasting rollers 156 and 158. The adhesive application can be performed immediately after or simultaneously with the embossing treatment.

In synchronism with the release of the bleached kraft paper sheet from the roll 152, the first and second thin paper sheets 22 and 26 are released from the raw sheet rolls 162 and 164, respectively, so as to be superposed on the upper and lower surfaces of the raw material sheet of the embossed paper sheet 24 and, then, adhered to the raw material sheet of the embossed paper sheet 24 by a pair of clearance rollers 166 and a pressing belt 168. One of the paired rollers 166 is fixed and the other roller is elastically urged toward said one roller by a spring force such that a predetermined clearance is formed between the paired rollers. The particular construction permits the first and second thin paper sheets 22 and 26 to be adhered to the embossed paper sheet 24 without collapsing the embossment 25.

The raw material sheet having the first and second thin paper sheets 22 and 26 adhered to the embossed paper sheet 24 is cut by a cutter 172 to prepare intermediates 165 each having a predetermined width. The intermediate 165 is sized such that a plurality of the protective covers 20 can be prepared from each intermediate 165.

On the other hand, an off-set printing by a printer 176 or a varnish coating is applied to the surface of the raw material sheet of the liner board 28 in order to obtain a raw material sheet roll 174 of the liner board 28. By this printing, letters or patterns relating to the trade name of the heat-insulating cup are imparted to the surface of the raw material sheet of the liner board 28, said surface forming the outer surface of the protective cover 20 of the resultant heat insulating cup. Then, the raw material sheet of the liner board 28 is cut by a cutter 178 to prepare intermediates 175 equal in size to the intermediates 165.

Further, the intermediates 165 are stacked one upon the other and automatically fed one by one by a feeder 182, followed by supplying the second thin paper sheet 26 of the intermediate 165 with an adhesive, e.g., vinyl acetate type adhesive, by an adhesive-application roller 186. The intermediates 175 are also stacked one upon the other and fed one by one by a feeder 184 in synchronism with the feeding of the intermediate 165 such that the intermediate 175 is superposed on the adhesive-applied surface of the intermediate 165 and adhered to the intermediate 165 by a pair of clearance rollers 188 and a pressing belt 192 so as to obtain an intermediate 194 of the adhered structure. One of the paired rollers 188 is fixed, with the other roller being elastically movable by a spring force toward said one roller, with the result that the intermediates 165 and 175 can be adhered to each other without collapsing the embossment 25 of the embossed paper sheet 24.

The intermediate 194 of the adhered structure, which comprises a plurality of sectoral regions each having the letters or patterns relating to the trade name of the heat insulating cup printed thereon, is die-cut in the subsequent step to obtain a plurality of sectoral blanks 32 of the protective cover 20. Further, the protective cover 20 is attached to the cup body 12 as described previously so as to obtain a heat-insulating cup as shown in FIG. 17.

In the manufacturing process shown in FIG. 18, a plurality of intermediate>165 each including the embossed paper sheet 24 are stacked one upon the other. In this step, however, the projections/recesses, i.e., embossment 25, of the embossed paper sheets 24 included in the adjacent intermediates 165 are not engaged with each other because the first and second thin paper sheets 22 and 26 are adhered in advance to the surfaces of each embossed paper sheet 24. As a result, the intermediates 165 can be automatically fed one by one for the adhering of the liner board 28 to the intermediate 165 in the subsequent step, leading to an improved productivity of the heat-insulating cup. Further, the second thin paper sheet 26 prevents the liner board 28 from bearing traces of the adhering operation and from bearing the irregularity conforming with the surface state of the embossed paper sheet 24. In short the second thin paper sheet 26 is effective for preventing the appearance of the heat-insulating cup from being impaired.

The first thin paper sheet 22 of the protective cover 20 is adhered with an adhesive to the side wall 14 of the cup body 12 for fixing the protective cover 20 to the cup body 12. It follows that, even if the protective cover 20 is wound about the side wall 14 in the adhering step, the protective cover 20 can be adhered without fail to the cup body 12. Also, a point-to-point adhering is achieved between the first thin paper sheet 22 and projections of the embossed paper sheet 22 and between the second thin paper sheet 26 and projections of the embossed paper sheet 22. The adhering operation is performed on a flat plane or a curved plane of a large curvature radius. Also, each of the first and second thin paper sheets 22 and 26 can be deformed as desired. It follows that the first and second thin paper sheets 22 and 26 can be adhered satisfactorily to the embossed paper sheet 24.

In the manufacturing process shown in FIG. 18, the intermediates 165 of a predetermined width are automatically fed one by one for formation of the intermediates 194. However, the automatic feeding from a roll as shown in FIG. 5 can be employed in place of the feeding performed one by one. Specifically, the raw material sheets of the first and second thin paper sheets 22 and 26 are adhered to the upper and lower surfaces of the embossed paper sheet 24 to obtain a laminate structure, followed by taking up the laminate structure as a first roll before cutting, said roll corresponding to the roll 108 shown in FIG. 5. On the other hand, letters or patterns are consecutively printed on the surface of the raw material sheet before cutting of the liner board 28, followed by taking up the raw material sheet printed with letters or the like as a second roll corresponding to the roll 112 shown in FIG. 5. Then, these raw material sheets are released from the first and second rolls in synchronism with each other such that the raw material sheet of the liner board 28 is adhered to the second thin paper sheet 26 of the raw material sheet of the laminate structure released from the first roll. Further, the resultant adhered sheet is cut to obtain the intermediates 194 of a predetermined size, or to obtain directly the sectoral blank 32 of the protective cover 20.

In the modified process described above, it is possible not to take up the first roll, but to feed the adhered raw material sheets 22, 24 and 26 as they are, and to directly combine them with the raw material sheet of the liner board 28 fed from the second roll.

Figure 17B:
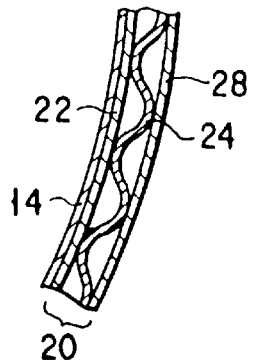

Further, any one of the first and second thin paper sheets 22 and 26 can be added to the protective cover 20 shown in FIG. 2, comprising the embossed paper sheet 24 and the liner board 28. In this case, the projections/recesses, i.e., embossment 25, of the embossed paper sheets 24 included in the adjacent intermediates stacked one upon the other are not engaged with each other. It follows that the embossed paper sheet 24 can be automatically fed from a roll or automatically fed one by one easily, leading to an improved productivity and a low manufacturing cost of the heat insulating cup.

Where the first thin paper sheet 22 alone is adhered to the protective cover 20 comprising the embossed paper sheet 24 and the liner board 28, as shown in particularly FIG. 17B, an area-to-area contact is achieved between the first thin paper sheet 22 and the cup body 12, leading to an improved adhering strength between the cup body 12 and the protective cover 20. Also, the embossed paper sheet 24 is sandwiched between the first thin paper sheet 22 and the liner board 28. It follows that the embossed paper sheet 24 is prevented from deformation such as warping with time so as to ensure a high adhering strength between the cup body 12 and the protective cover 20 over a long period of time.

In the case of adding the second thin paper sheet 26 alone to the protective cover 20, the second thin paper sheet 26 prevents the liner board 28 from bearing an irregularity conforming with the surface state of the embossed paper sheet 24 or from bearing traces of the adhering operation, so as to prevent the appearance of the heat insulating cup from being impaired.

FIG. 19 is a perspective view, partly broken away, showing a heat insulating cup 10 according to another embodiment of the present invention, said cup 10 including a cap 11A which is shown away from the cup 10. The reference numerals which were already explained in conjunction with the embodiment shown in FIGS. 1 and 2 are also used in FIG. 19 for denoting the same members of the cup.

In this embodiment, a black horizontal line 52 is drawn as a marking line over substantially the entire outer circumferential surface of the side wall 14 of the cup body 12 so as to provide a criterion in pouring, for example, hot water into the cup. The marking line 52 can be printed with a black ink using, for example, a carbon black on the paper board used for preparing the side wall 14. The marking line 52 should be printed such that, when the paper board printed with the line 52 is wound to form the side wall 14, both ends of the line 52 should be aligned so as to enable the line 52 to designate a predetermined liquid level within the cup.

The cap 11A made of a transparent resin molding is mounted to the flange portion 18 of the side wall 14. It is possible to use the cap 11A made of paper. Further, a sheet-like lid 11 as shown in FIG. 1 can be mounted in place of the cap 11A to the flange portion 18.

Figure 22:
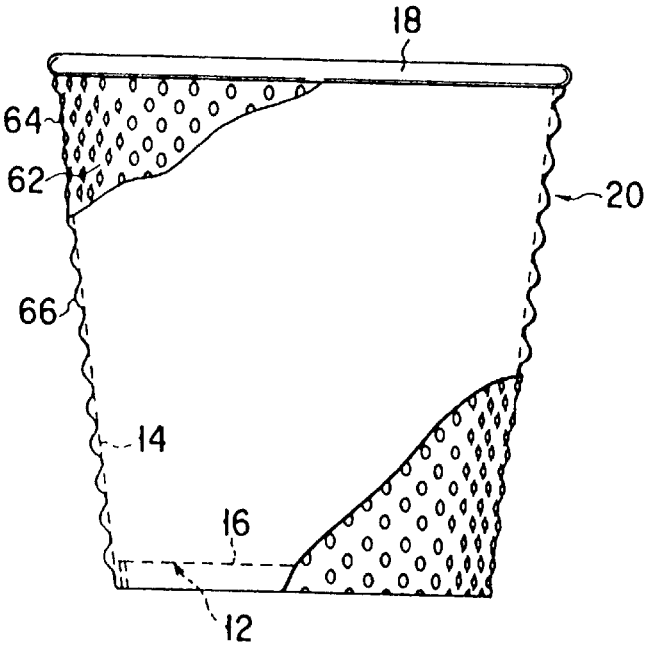
FIG. 22 is a front view, partly broken away, showing a heat insulating cup according to still another embodiment of the present invention.

The protective cover 20 used in the embodiment of FIG. 19 is of a multi-layer structure consisting of the first thin paper sheet 22, the embossed paper sheet 24 and the paper liner board 28. However, the protective cover 20 may be of other multi-layer structure. For example, the protective cover 20 may consist of the embossed paper sheet 24 and the liner board 28 as shown in FIG. 2, or may consist of the first thin paper sheet 22, the embossed paper sheet 24, the second thin paper sheet 26 and the liner board 28, as shown in FIG. 16. Further, the protective cover 20 may be formed of the embossed paper sheet alone, as shown in FIG. 22 which is to be described later.

The marking line 52 should be visually recognized from within the cup body 12 covered with the protective cover 20. In order to facilitate the visual recognition, it is important to determine appropriately the materials and other conditions of the side wall 14 and the line 52. Of course, it is most desirable for the line 52 to be visually recognized by only the light from within the cup body 12. In view of these requirements, the paper board used for forming the side wall 14 should have a basis weight falling within a range of between 170 g/m$^2$ and 310 g/m$^2$ and should have a thickness falling within a range of between 220 $\mu$m and 420 $\mu$m. The Munsell system brightness Bw of the color of side wall 14 should be 6 to 10, preferably 8 to 10. The Munsell system brightness Bm of the color of the marking line 52 should be 0 to 7, preferably 0 to 5. Further, it is important to meet the condition: $Bw-Bm \geqq 3$.

For facilitating the visual recognition of the marking line 52, it is also important to meet the condition of $Bc-Bm \geqq 1$, where Bc denotes the Munsell system brightness of the color of the thin paper sheet 22, which is the color of the inner surface of the protective cover 20. Further, the value of Bc should fall within a range of between 6 and 10, preferably between 8 and 10. Incidentally, it has been experimentally confirmed that, in the case of using the marking line 52 having the Munsell system brightness of 0, the marking line 52 can be slightly recognized visually even if the Munsell system brightness of the inner surface of the protective cover 20 is very close to zero. Where the thin paper sheet 22 is excluded from the protective cover 20, the inner surface of the protective cover 20 is defined by the embossed paper sheet 24. It follows that the color of the embossed paper sheet 24 is determined in accordance with the above-noted conditions for selecting the color of the thin paper sheet 22.

If the basis weight and thickness of the pasteboard used for forming the side wall 14 are higher than the upper limits of the ranges described previously, it is difficult to visually recognize easily the marking line 52. On the other hand, if these basis weight and thickness are lower than the lower limits of the ranges described previously, the paper board fails to have a rigidity and mechanical strength required for the cup body 12. If the Munsell system brightness Bw of the paper board used for forming the side wall 14 is lower than the lower limit of the range described previously, it is difficult to visually recognize easily the marking line 52. It is also difficult to visually recognize easily the marking line 52, if the Munsell system brightness Bm of the marking line 52 is higher than the upper limit of the range described previously. It is desirable for each of the paper board used for forming the side wall 14, the thin paper sheet 22 and the marking line 52 to be colorless, though it is acceptable for these members of the cup to be colored. Further, the marking line 52, which is a single straight line in the embodiment of FIG. 19, may be replaced by, for example, a broken line, a double line, a linear arrangement of small triangles, dots, letters, numerals, etc.

Figure 20:
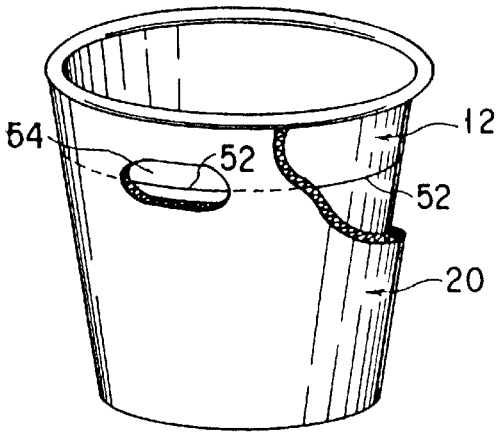
FIG. 20 is a perspective view, partly broken away, showing a modification of the heat insulating cup shown in FIG. 19.

FIG. 20 is a perspective view, partly broken away, showing a modification of the heat insulating cup shown in FIG. 19. In the modification shown in FIG. 20, an open widow 54, which is laterally oblong, is formed in the protective cover 20 so as to expose partly the marking line 52 formed on the outer circumferential surface of the cup body 12. The window 54 can be formed in the die-cutting step of the blank 32 of the protective cover 20, with the result that the window 54 can be formed with no substantial increase in the manufacturing cost of the heat insulating cup. Also, since the marking line 52 is printed along the entire outer circumferential surface of the side wall 14 of the cup body 12, a horizontal position of the window 54 need not be aligned with the marking line 52.

The window 54 permits the marking line 52 to be visually recognized from within the cup body 12 by utilizing the external light, with the result that the marking line 52 can be visually recognized more easily. This makes it unnecessary to take the Munsell system brightness of the color of the inner surface of the protective cover 20, i.e., the thin paper sheet 22, into consideration, though it is necessary t o take the particular brightness into consideration in the heat insulating cup shown in FIG. 19. However, since it is necessary to utilize the external light for visually recognizing the marking line 52, it is necessary for the paper board used for forming the side wall 14 to have a basis weight of 170 g/m$^2$ to 310 g/m$^2$ and a thickness of 220 $\mu$m to 420 $\mu$m. On the other hand, the Munsell system brightness Bw of the color of side wall 14 should be 6 to 10, preferably 8 to 10. The Munsell system brightness Bm of the color of the marking line 52 should be 0 to 8, preferably 0 to 7. Further, it is important to meet the condition: $Bw-Bm \geqq 2$.

It is desirable for each of the pasteboard used for forming the side wall 14 and the marking line 52 to be colorless, though it is acceptable for these members of the cup to be colored. Further, the marking line 52, which is exposed by the open window 54 and is formed of a single straight line in the modification shown in FIG. 20, may be replaced by, for example, a broken line, a double line, a linear arrangement of small triangles, dots, letters, numerals, etc.

The window 54 facilitates the visual recognition of the marking line 52 from within the cup. In addition, the surface level of the liquid poured into the cup can be recognized through the window 54 from outside the cup. In other words, the surface level of the liquid poured into the cup can be compared with the marking line 52. In this fashion, the window 54 is highly useful in the case where the user of the cup is unable to peep into the cup.

It is possible to enlarge the window 54 or to provide a plurality of windows 54 so as to further facilitate the visual recognition of the marking line 52. It should be noted, however, that, if the open area made by the window 54 is unduly large, the heat insulating properties of the cup are lowered.

Figure 21:
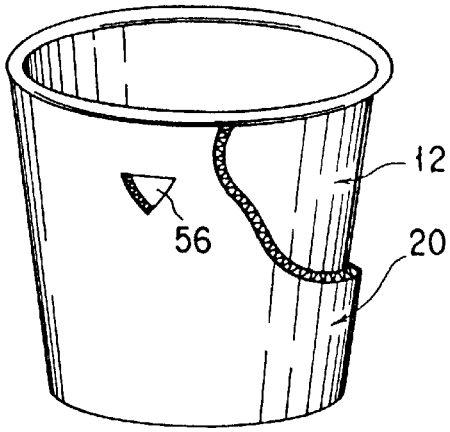
FIG. 21 is a perspective view, partly broken away, showing another modification of the heat insulating cup shown in FIG. 19.

FIG. 21 is a perspective view, partly broken away, showing another modification of the heat insulating cup shown in FIG. 19. In the modification of FIG. 21, the marking line 52 is not drawn at all on the cup body 12. Also, a triangular window 56 is formed in the protective cover 20. The window 56 can be formed in the die-cutting step for forming the blank 32 of the protective cover 20, with the result that the window 56 can be formed with no substantial increase in the manufacturing cost of the heat insulating cup.

The window 56 can be recognized from within the heat insulating cup by utilizing the external light, with the result that the contour itself of the window 56 can be used a mark of criterion. This makes it unnecessary to draw a marking line 52 as in the heat insulating cup shown in FIG. 19. It is also unnecessary to take the Munsell system brightness of the color on the inner surface of the protective cover 20, i.e., the thin paper sheet 22, into consideration. However, since it is necessary to recognize the contour of the window 56 by utilizing the external light, it is necessary for the paper board used for forming the side wall 14 to have a basis weight falling within a range of between 170 g/m$^2$ and 310 g/m$^2$ and a thickness falling within a range of between 220 $\mu$m and 420 $\mu$m.

As described above, the window 56 can be recognized from inside the cup, making it possible to use the window 56 as a marking criterion. In addition, the surface level of the liquid poured into the cup can be recognized through the window 56 from outside the cup. It follows that the surface level of the liquid poured into the cup can be compared with the marking criterion by utilizing the window 56. In this fashion, the window 56 is highly useful in the case where the user of the cup is unable to peep into the cup.

It is possible to enlarge the window 56 or to provide a plurality of windows 56 so as to further facilitate the visual recognition of the marking criterion. It should be noted, however, that, if the open area made by the window 56 is unduly large, the heat insulating properties of the cup are lowered.

FIG. 22 is a perspective view, partly broken away, showing a heat insulating cup according to still another embodiment of the present invention. The reference numerals which were already explained in conjunction with the embodiment shown in FIGS. 1 and 2 are also used in FIG. 22 for denoting the same members of the cup.

In this embodiment, the protective cover 20 is formed of an embossed paper sheet 62 alone. The embossed paper sheet 62 is formed of a paper board having a thickness of 0.1 to 0.2 mm and a basis weight of 310 to 315 g/m$^2$. A large number of dotted projections 66 forming embossment 64 are formed over the entire region of the embossed paper sheet 62. To be more specific, the projections 66 have a circular cross sectional shape having a diameter falling within a range of between 2 mm and 5 mm and also have a height falling within a range of between 1 mm and 2 mm. The diameter of the circular cross sectional shape and the height of these projections 66 should be uniform over the entire region of the embossed paper sheet 62. These projections 66 should be formed at a density falling within a range of between 3/cm$^2$ and 10/cm$^2$ and should be equidistantly arranged to form a large number of first rows each making an angle of about 45° with the axis of the cup body 12 and a large number of second rows substantially perpendicular to the first rows. In other words, the projections 66 should be equidistantly arranged to form a lattice.

Figure 23:
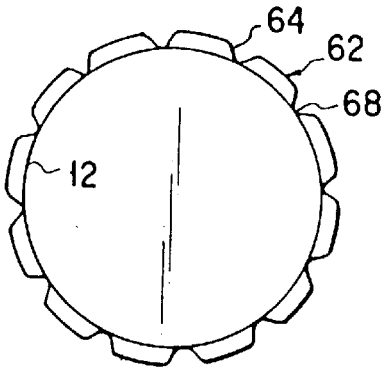
FIG. 23 is a plan view schematically showing a modification of the heat insulating cup shown in FIG. 22.

FIG. 23 is a plan view schematically showing a modification of the heat insulating cup shown in FIG. 22. In this modification, the embossment 64 of the embossed paper sheet 62 consist of recesses 68. These recesses 68 have a circular cross sectional shape having a diameter falling within a range of between 2 mm and 5 mm and also have a depth falling within a range of between 1 mm and 2 mm. The diameter of the circular cross sectional shape and the depth of these recesses 68 should be uniform over the entire region of the embossed paper sheet 62. These recesses 68 should be formed at a density falling within a range of between 3/cm$^2$ and 10/cm$^2$ and should be equidistantly arranged to form a large number of first rows each making an angle of about 45° with the axis of the cup body 12 and a large number of second rows substantially perpendicular to the first rows. In other words, the recesses 68 should be equidistantly arranged to form a lattice.

Figure 24:
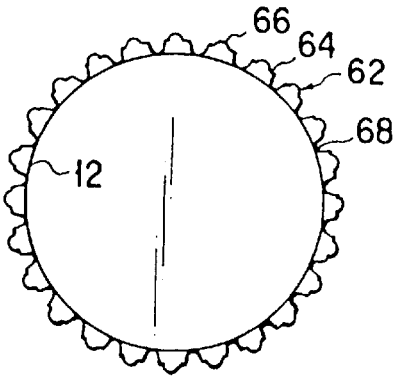
FIG. 24 is a plan view schematically showing another modification of the heat insulating cup shown in FIG. 22.

FIG. 24 is a plan view schematically showing another modification of the heat insulating cup shown in FIG. 22. In this modification, the embossment 64 of the embossed paper sheet 62 consist of circular projections 66 and recesses 68. These circular projections 66 and recesses 68 are alternately arranged equidistantly. These projections 66 and recesses 68 should be arranged to form a large number of first rows each making an angle of about 45° with the axis of the cup body 12 and a large number of second rows substantially perpendicular to the first rows. In other words, these projections 66 and recesses 68 are arranged to form lattices complimentarily overlapping each other. Each of these projections 66 and recesses 68 has a circular cross sectional shape having a diameter falling within a range of between 2 mm and 5 mm. Also, the projections are arranged at a density falling within a range of between 3/cm$^2$ and 10/cm$^2$, while the recesses are arranged at a density falling within a range of between 3/cm$^2$ and 10/cm$^2$. Further, the vertical distance between the top of the projection 66 and the bottom of the recess 68 should fall within a range of between 2 mm and 4 mm. Of course, these projections 66 and recesses 68 should be formed such that the vertical distance between the top of the projections and the bottom of the recesses should be uniform over the entire region of the embossed paper sheet 62.

In the heat insulating cup shown in each of FIGS. 22 to 24, free spaces defined by the projections 66 and/or recesses 68 of the embossed paper sheet 62 and the side wall 14 of the cup body 12 are formed between the side wall 14 of the cup body 12 and the embossed paper sheet 62 wound about the outer surface of the side wall 14 so as to produce a heat insulating effect. Also, since the density of the projections 66 and/or recesses 68 formed in the embossed paper sheet 62 is defined to fall within the range described above, fingers of the user holding the cup are prevented from directly contacting that region of the embossed paper sheet 62 which is in direct contact with the cup body 12 heated to a high temperature. In other words, any finger is markedly thicker than the clearance between adjacent projections formed in the embossed paper sheet 62, making it possible to prevent the finger from touching a high temperature region of the heat insulating cup. Clearly, the embossed paper sheet 62 is effective for providing a heat insulating cup of a simple structure. Incidentally, the projections 66 and the recesses 68 of the embossed paper sheet 62 are circular in cross section. Of course, it is also possible for these projections 66 and recesses 68 to have other cross sectional shapes such as a rectangular or hexagonal cross sectional shape. It is also possible to impart letters or patterns denoting the trade name of the cup to the surface of the embossed paper sheet.

Figure 25:
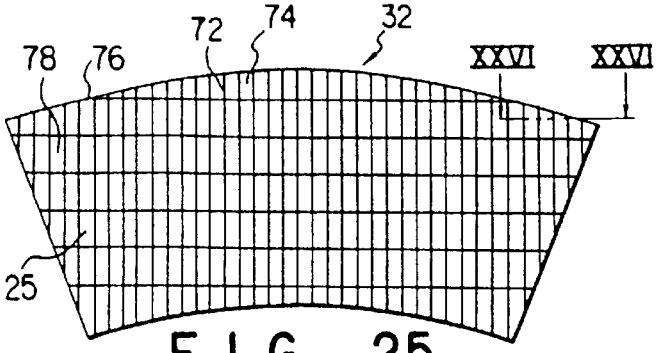
FIG. 25 is a plan view showing still another modification of the blank of a protective cover.

FIG. 25 is plan view showing still another modification of the blank 32 of a protective cover 20. This modification of the blank 32 is of a multi-layer structure the same as the blank 32 of a protective cover 20 used in the heat insulating cup 10 shown in FIG. 1. Namely, this blank 32 comprises an embossed paper sheet 24 and a paper liner board 28 adhered via an adhesive. The embossed paper sheet 24 is to be attached to the side wall 14 of the cup body 12. FIG. 25 shows the inner surface of the blank 32, e.g., the face of the embossed paper sheet 24.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

The modified structure shown in FIG. 25 is characterized in that a corrugated paper sheet is used as the raw material sheet of the embossed paper sheet 24 and is subjected to a specific treatment. By doing so, it is possible to facilitate and ensure the winding of the blank 32 to form a protective cover 20. In the blank 32 of a protective cover shown in FIG. 25, conditions of the paper liner board 28 and the adhesive for adhering the paper liner board 28 and the embossed paper sheet 24 are the same as those of the protective cover 20 of the heat insulating cup 10 shown in FIG. 1. Therefore, this modified blank 32 of a protective cover will be explained with reference mainly to the embossed paper sheet 24.

Figure 26:
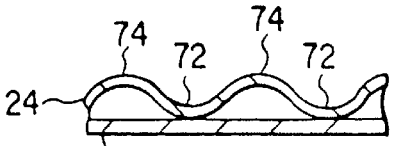
FIG. 26 is a cross sectional view along line XXVI—XXVI shown in FIG. 25.

The embossed paper sheet 24 of the blank 32 shown in FIG. 25 is made of a white, bleached kraft paper, and has a basic weight of 120 g/m$^2$. The embossed paper sheet 24 has a number of vertical grooves 72 which are arranged at regular intervals, extended in parallel and connected to upper and lower arcs of the blank 32. The vertical grooves 72 are oriented parallel to the center line connecting the upper and lower arcs of the blank 32. As shown in FIG. 26, ridges 74 are formed between the vertical grooves 72, and protrude from the paper liner board 28. The vertical grooves 72 and the ridges 74 are derived from the corrugation of the corrugated paper sheet which has been used as the raw material sheet of the embossed paper sheet 24.

The embossed paper sheet 24 also has a plurality of horizontal grooves 76 which are arranged at regular intervals over the entirety of the embossed paper sheet 24, and perpendicularly intersect the vertical grooves 72. The horizontal grooves 76 are formed of ruled lines which are provided by pressing the corrugated paper sheet, used as the raw material sheet of the embossed paper sheet 24, with blades, after the corrugated paper sheet is adhered to the paper liner board 28. The depth of the horizontal grooves 76 is almost the same as that of the vertical grooves 72. In other words, the embossed paper sheet 24 shown in FIG. 25 has an embossment 25 which consists of a number of longitudinal dot-like projections 78 defined by the vertical and horizontal grooves 72 and 76. The embossed paper sheet 24 is adhered to the paper liner board 28 at positions corresponding to the grooves 72 and 76, and insulating gaps are formed between the embossed paper sheet 24 and the paper liner board 28 at positions corresponding to the projections 78.

In this modification, the vertical grooves 72 are arranged at a density falling within a range of between 3/cm and 5/cm. The height of the embossment 25, which is a vertical distance between the rear bottom surface of the grooves 72 and 76 and the top surface of the ridge 74, falls within a range of between 0.7 mm and 1.6 mm. Each of the vertical grooves 76 has a width of about 1 mm at the bottom and of about 4 mm at the top. The pitch of the vertical grooves 76 is about 10 mm.

In view of the desired heat insulating properties and strength of the protective cover 20, it is possible that the basic weight of the embossed paper sheet 24 falls within a range of between 50 g/m$^2$ and 180 g/m$^2$, the density of the vertical grooves 72 falls within a range of between 0.5/cm, and 5/cm, and the height of the embossment 25 falls within a range of 1 mm and 5 mm. There may be various manners in the dimension, shape, arrangement and so forth of the horizontal grooves 76, as described below.

The horizontal grooves 76 are desirably formed in the die-cutting step of the sectoral blank 32 of a protective cover, such as when the intermediate 128 is die-cut in conformity with the blanks 32, as shown in FIG. 5. In this case, pressing blades may be arranged to correspond to the horizontal grooves 76 for forming them, and used along with a die-cutting blade for forming the contour of the blank 32 of a protective cover. The horizontal grooves 76, however, may be formed at any time after the adhering step of the paper liner board 28 to the corrugated paper sheet, used as the raw material sheet of the embossed paper sheet 24, and before or during the die-cutting step of the blank 32 of a protective cover. For example, in the process shown in FIG. 5, the horizontal grooves 76 can be formed at an arbitrary time after the raw material sheets of the embossed paper sheet 24 and paper liner board 28 are adhered to each other at the pressing belt 124, and before or while the intermediate 128 is die-cut into the blanks 32.

If the horizontal grooves 76 were formed before the step of adhering the paper liner board 28 to the corrugated paper sheet, used as the raw material sheet of the embossed paper sheet 24, the corrugation of the corrugated paper sheet would totally collapse. On the other hand, if the horizontal grooves 76 were formed after the die-cutting step of the blank 32 of a protective cover, formation of the grooves 76 would be troublesome.

According to the blank 32 of a protective cover shown in FIG. 25, the corrugated paper sheet used as the raw material sheet of the embossed paper sheet 24 is easily available in the market, no special dies are necessary for forming the embossment 25 of the embossed paper sheet 24. As a result, the blank 32 of a protective cover can be inexpensively provided. Furthermore, the horizontal grooves 76 weaken the resilience of the corrugated paper sheet so as to facilitate and ensure the winding of the blank 32 to form the protective cover 20.

To be more specific, a corrugation paper sheet renders strong resilience or resistance against deformation except when the sheet is wound in accordance with the orientation of its corrugation. Therefore, if a corrugation paper sheet, as it is, were to be used as the embossed paper sheet 24, the blank 32 of a protective cover would be hardly wound into a predetermined truncated cone shape. In particular, where the blank 32 is adhered to the cup body 12 while being wound around it, such a blank 32 employing a corrugation paper sheet as it is would worsen workability. The blank 32 of the protective cover shown in FIG. 25 can solve this problem.

FIGS. 27 to 30 are plan views showing still other modifications of the blank of a protective cover shown in FIG. 25.

Figure 27:
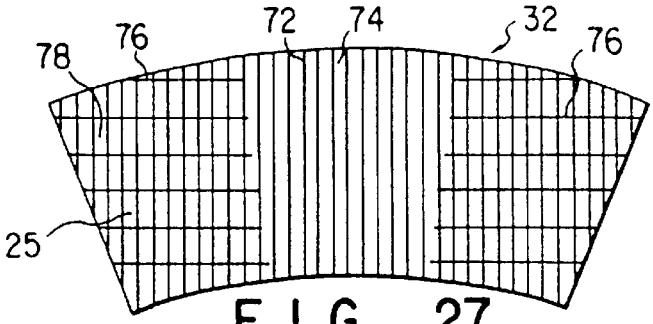
FIG. 27 is a plan view showing still another modification of the blank of a protective cover.

In the blank 32 of a protective cover shown in FIG. 27, the horizontal grooves 76 are not formed in the central region of the blank 32, but are formed in regions each having a surface area of one-third the total surface area and including either lateral side of the blank 32. The other conditions of the blank 32 shown in FIG. 27 are the same as those of the blank 32 shown in FIG. 25. When the blank 32 is wound into the protective cover 20, resilience of the blank 32 at both of the lateral sides especially cause problems in workability. The structure shown in FIG. 27 is adopted from this point of view. The inner ends of the horizontal grooves 76 extend more to the central region of the blank 32 as the horizontal grooves 76 grow closer to the lower arc of the blank 32. In FIG. 27, the inner ends of the horizontal grooves 76 are arranged along essentially two radial lines extending from the central point of the upper and lower arcs. With the inner ends of the horizontal grooves 76 arranged as described above, it becomes easier to wind the blank 32 of a protective cover into a predetermined truncated cone shape.

Figure 28:
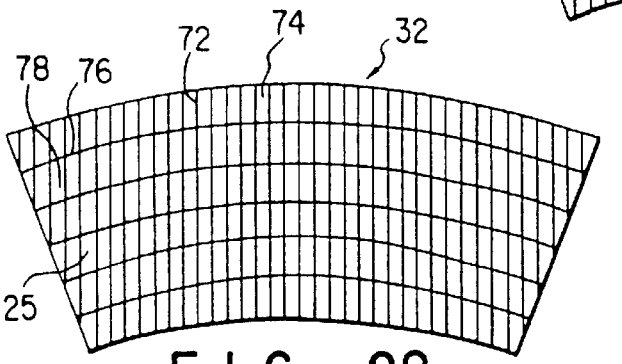
FIG. 28 is a plan view showing still another modification of the blank of a protective cover.

In the blank 32 of a protective cover shown in FIG. 28, the horizontal grooves 76 extends along arcs other than lines perpendicular to the vertical grooves 72. The arcs of the horizontal grooves 76 are arranged coaxial to the upper and lower arcs of the blank 32 and connect both the lateral sides of the blank 32. The other conditions of the blank 32 shown in FIG. 28 are the same as those of the blank 32 shown in FIG. 25. As in this blank 32, the horizontal grooves 76 are not limited to linear ones perpendicular to the vertical grooves 72, but are sufficient so long as they can weaken the resilience of the corrugated paper sheet.

Figure 29:
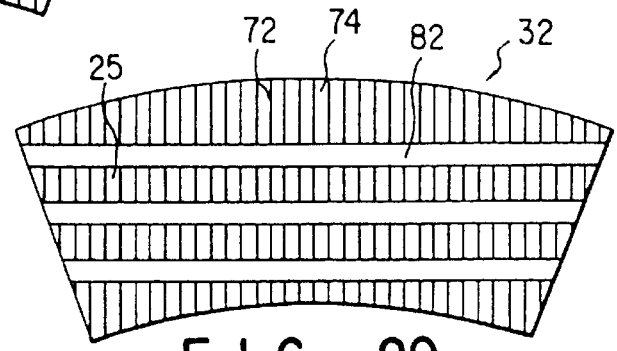
FIG. 29 is a plan view showing still another modification of the blank of a protective cover.

In the blank 32 of a protective cover shown in FIG. 29, horizontal grooves 82 having a greater width of, e.g., 10 mm, are arranged to extend perpendicular to the vertical grooves 72. The other conditions of the blank 32 shown in FIG. 29 are the same as those of the blank 32 shown in FIG. 25. The horizontal grooves 82 shown in FIG. 29 are formed by pressing down part of the corrugation of a corrugated paper sheet used as the raw material sheet of the embossed paper sheet 24 with rollers or the like. The horizontal grooves 82 can also be formed any time after the step of adhering the paper liner board 28 to the corrugated paper sheet, used as the raw material sheet of the embossed paper sheet 24, and before or during the die-cutting step of the blank 32 of a protective cover.

Figure 30:
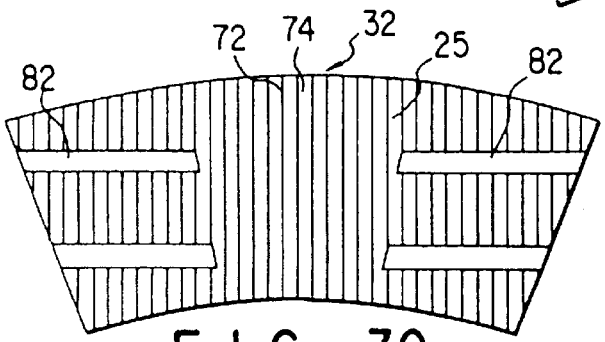
FIG. 30 is a plan view showing still another modification of the blank of a protective cover.

In the blank 32 of a protective cover shown in FIG. 30, the horizontal grooves 82 similar to those in FIG. 29 are arranged. However, the horizontal grooves 82 are not formed in the central region of the blank 32, but are formed in regions each having a surface area of one-third the total surface area and including either lateral side of the blank 32. The other conditions of the blank 32 shown in FIG. 30 are the same as those of the blank 32 shown in FIG. 25. The horizontal grooves 82 closer to the lower arc have inner ends which extend more to the central region of the blank 32 than those of the horizontal grooves 82 closer to the upper arc. In addition, the inner ends of the horizontal grooves 82 are inclined to diverge toward the upper arc. In FIG. 30, the positions and inclined shapes of the inner ends of the horizontal grooves 82 are arranged along essentially two radial lines extending from the central point of the upper and lower arcs.

According to the modified structures shown in FIGS. 27 to 30, it is possible to provide an inexpensive blank 32 of a protective cover, and to facilitate and ensure the winding of the blank 32 to form a protective cover 20, as in the structure shown in FIG. 25. Note that a corrugated paper sheet used as a raw material sheet of the embossed paper sheet 24 may have a corrugation which has meandering or snaking vertical grooves other than straight grooves.

What is claimed is:

1. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside and wherein said embossed paper sheet has a basis weight falling within a range of between 50 g/m$^2$ and 180 g/m$^2$, and said liner board has a basis weight falling within a range of between 180 g/m$^2$ and 270 g/m$^2$.

2. The heat insulating cup according to claim 1, wherein said blank of the protective cover has two side end portions and is adhered to the side wall of said cup body such that both side end portions of the blank are arranged opposite each other.

3. The heat insulating cup according to claim 1, further comprising a flange portion prepared by folding outward an open upper circumferential end region of said side wall of said cup body such that the folded portion makes at least one complete turn, followed by pressing in a vertical direction said folded portion, said folded portion being prevented from being adhered on its inner surface, and a position of an upper end portion of the protective cover and a material of the side wall being selected such that a gap appearing along the outer surface of the protective cover between the protective cover and the flange portion has a width diminished to 0.5 mm or less by deformation of the flange portion caused by a self-restoring force of the flange portion.

4. The heat insulating cup according to claim 3, wherein a lower surface of said flange portion abuts against the upper end portion of the protective cover so as to prevent said flange portion from being further deformed by its self-restoring force.

5. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside, and wherein an inner surface of said side wall is covered with a plastic layer having a thickness of 20 to 60 $\mu$m, and a matting treatment is applied to the surface of said plastic layer to enable the plastic layer to have a ten points mean roughness falling within a range of between 10 $\mu$m and 30 $\mu$m, which is not more than 60% of the thickness of said plastic layer.

6. The heat insulating cup according to claim 5, wherein an outer surface of said linear board is covered with a varnish layer.

7. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside, and wherein a surface embossment of a plurality of elements is formed on the outer surface of the liner board to form a projected and recessed pattern, the elements of said projected and recessed pattern having an average width falling within a range of between 500 $\mu$m and 1500 $\mu$m, and said surface embossment having a ten points mean roughness falling within a range of between 40 $\mu$m and 100 $\mu$m.

8. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside, and wherein said protective cover is adhered to said side wall with an adhesive, which comprises a first part imparted with a pressure to two band-like first regions formed at side end regions of said blank of the protective cover, and a second part imparted without a pressure to at least one second region interposed between the two first regions.

9. The heat insulating cup according to claim 8, wherein said adhesive further comprises a third part imparted along with said first part with said pressure to a band-like region along a center line of said blank of the protective cover.

10. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside, and wherein said protective cover further comprises a thin paper sheet arranged on at least one surface of said embossed paper sheet and having a basis weight falling within a range of between 20 g/m$^2$ and 100 g/m$^2$.

11. The heat insulating cup according to claim 10, wherein said thin paper sheet is arranged between said side wall and said embossed paper sheet.

12. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside, and wherein said protective cover further comprises a perforation serving to facilitate the winding operation.

13. The heat insulating cup according to claim 12, wherein said protective cover further comprises cutouts formed at the upper and lower ends of said perforation.

14. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside, and wherein a marking as a criterion of liquid pouring into the cup is printed on an outer surface of said side wall of the cup body; said side wall is formed of a paper sheet having a basis weight falling within a range of between 170 g/m$^2$ and 310 g/m$^2$ and a thickness falling within a range of between 220 $\mu$m and 420 $\mu$m; the paper sheet of said side wall has a Munsell system brightness Bw of a color falling within a range of between 6 and 10; said marking has a Munsell system brightness Bm of a color falling within a range of between 0 and 7; and the relationship Bw−Bm>3 is satisfied.

15. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside, and wherein a marking as criterion of liquid pouring into the cup is printed on an outer surface of said side wall of the cup body; an open window is formed in said protective cover to expose at least partly said marking; said side wall is formed of a paper sheet having a basis weight falling within a range of between 170 g/m$^2$ and 310 g/m$^2$ and a thickness falling within a range of between 220 $\mu$m and 420 $\mu$m; the paper sheet of said side wall has a Munsell system brightness Bw of a color falling within a range of between 6 and 10; said marking has a Munsell system brightness Bm of a color falling within a range of between 0 and 8; and the relationship Bw−Bm>2 is satisfied.

16. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside, and wherein an open window acting as a marking as a criterion of liquid pouring into the cup is formed in said protective cover; and said side wall is formed of a paper sheet having a basis weight falling within a range of between 170 g/m$^2$ and 310 g/m$^2$ and a thickness falling within a range of between 220 $\mu$m and 420 $\mu$m.

17. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside, and annular embossed line acting as a marking as a criterion of liquid pouring into the cup is formed on the side wall.

18. A heat-insulating cup, comprising:

a cup body having a paper side wall and a paper bottom wall; and

A paper protective cover attached to cover the side wall of said cup body, wherein said protective cover is prepared by winding a blank of a multi-layer structure including an embossed paper sheet and a paper liner board adhered to said embossed paper sheet, said blank being wound such that said linear board is positioned outside, and wherein said embossed paper sheet is derived from a raw material sheet consisting of a corrugated paper sheet having a corrugation which defines a plurality of grooves;

said embossed paper sheet has a plurality of intersecting grooves, which intersect said grooves of the corrugation; and said intersecting grooves are arranged at least in a region including either lateral side of the blank.

19. The heat insulating cup according to claim 18, wherein said grooves of the corrugation are oriented substantially parallel to a central line connecting upper and lower sides of the blank.

20. The heat insulating cup according to claim 19, wherein said intersecting grooves are arranged over the entirety of said embossed paper sheet.

* * * * *